US011642679B2

(12) United States Patent
Rothman et al.

(10) Patent No.: US 11,642,679 B2
(45) Date of Patent: May 9, 2023

(54) PROCESS CONFIGURATIONS TO PREVENT EXCESS REGRINDING OF SCAVENGERING CONCENTRATES

(71) Applicant: CiDRA Corporate Services LLC, Wallingford, CT (US)

(72) Inventors: Paul J. Rothman, Windsor, CT (US); Adam Michael Jordens, West Hartford, CT (US); Peter A. Amelunxen, Colebay (SX)

(73) Assignee: CiDRA Corporate Services LLC, Wallingford, CT (US)

( * ) Notice: Subject to any disclaimer, the term of this patent is extended or adjusted under 35 U.S.C. 154(b) by 804 days.

(21) Appl. No.: 16/552,424

(22) PCT Filed: Feb. 28, 2018

(86) PCT No.: PCT/US2018/020113

§ 371 (c)(1),
(2) Date: Aug. 27, 2019

(87) PCT Pub. No.: WO2018/160628

PCT Pub. Date: Sep. 7, 2018

(65) Prior Publication Data

US 2020/0114370 A1 Apr. 16, 2020

Related U.S. Application Data

(60) Provisional application No. 62/464,505, filed on Feb. 28, 2017.

(51) Int. Cl.

| | |
|---|---|
| ***B03D 1/02*** | (2006.01) |
| ***B03D 1/08*** | (2006.01) |
| *B03D 1/14* | (2006.01) |

(52) U.S. Cl.
CPC ..... *B03D 1/023* (2013.01); *B03D 1/087* (2013.01); *B03D 1/1406* (2013.01)

(58) Field of Classification Search
CPC ..... B03D 1/023; B03D 1/14; B03D 1/1406; B03D 1/1418; B03D 1/1425;
(Continued)

(56) References Cited

U.S. PATENT DOCUMENTS 9,475,067 B2 * 10/2016 Bai ..... B02C 23/14
10,758,919 B2 9/2020 Filmer et al.
(Continued)

FOREIGN PATENT DOCUMENTS

WO 2010144939 12/2010
WO 2012162591 A1 11/2012
(Continued)

*Primary Examiner* — Joseph C Rodriguez
(74) *Attorney, Agent, or Firm* — Ware, Fressola, Maguire & Barber LLP

(57) ABSTRACT

A system includes a collection processor configured to receive tailings of a flotation process, the tailings having mineral particles of interest; and at least one collection apparatus located in the collection processor. The collection apparatus has a collection surface configured with a functionalized polymer having molecules with a functional group that attract the mineral particles of interest to the collection surface. The flotation process has scavenger circuits that provide scavenger circuit feeds having scavenger tails. The system features enhanced scavenger circuits having the collection apparatus located in the collection processor and configured to receive the scavenger circuit feeds and provide enhanced scavenger circuit feeds having enhanced scavenger tails and enhanced scavenger concentrate for further processing by the system.

44 Claims, 26 Drawing Sheets

Scavenging circuits for scavenger tails and cleaner scavenger tails in Figure 23 also with screening of the enhanced-scavengering-produced concentrate

(58) Field of Classification Search
CPC ..... B03D 2203/02; B03B 5/04; B03B 5/28; B03B 5/34; B03B 7/00; B03B 9/005
See application file for complete search history.

(56) References Cited

U.S. PATENT DOCUMENTS

| | | | | |
|---|---|---|---|---|
| 10,913,075 | B2 * | 2/2021 | Rinne | B03D 1/087 |
| 11,066,725 | B2 * | 7/2021 | Rothman | C22B 11/02 |
| 11,247,214 | B2 * | 2/2022 | Rothman | C22B 1/00 |
| 2011/0038770 | A1 | 2/2011 | Senior et al. | |
| 2015/0083646 | A1 | 3/2015 | Didden et al. | |
| 2015/0151308 | A1 | 6/2015 | Davis | |
| 2015/0209799 | A1 * | 7/2015 | Rothman | B01D 37/02 209/129 |
| 2017/0326559 | A1 * | 11/2017 | Filmer | B03D 1/08 |

FOREIGN PATENT DOCUMENTS

| | | | |
|---|---|---|---|
| WO | 2012162609 | A1 | 11/2012 |
| WO | 2017066752 | A1 | 4/2017 |
| WO | 2017087498 | | 5/2017 |

* cited by examiner

Reticulated Foam with Cu Mineral entrained throughout the structure

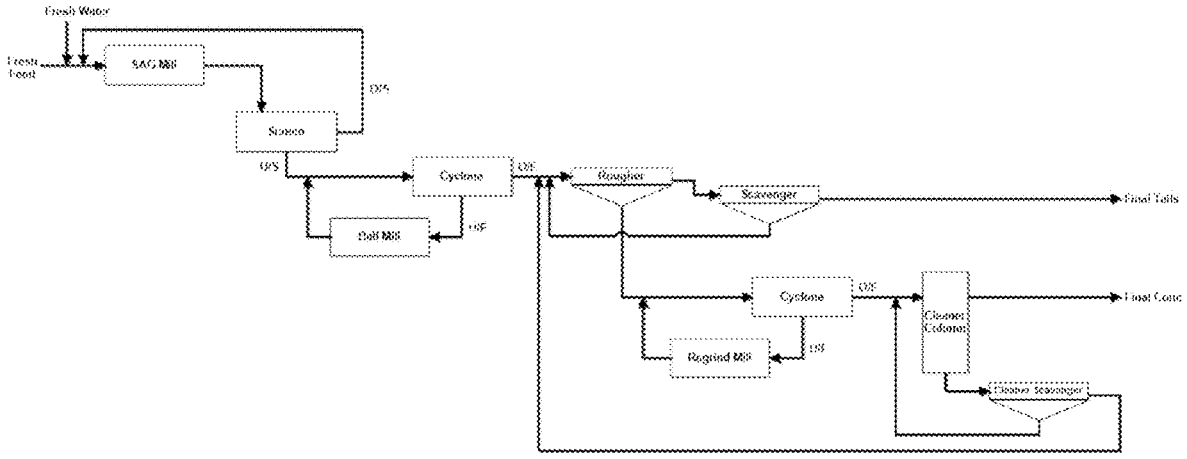
Figure 22: Flotation circuit without enhanced scavenging technology (Prior Art)
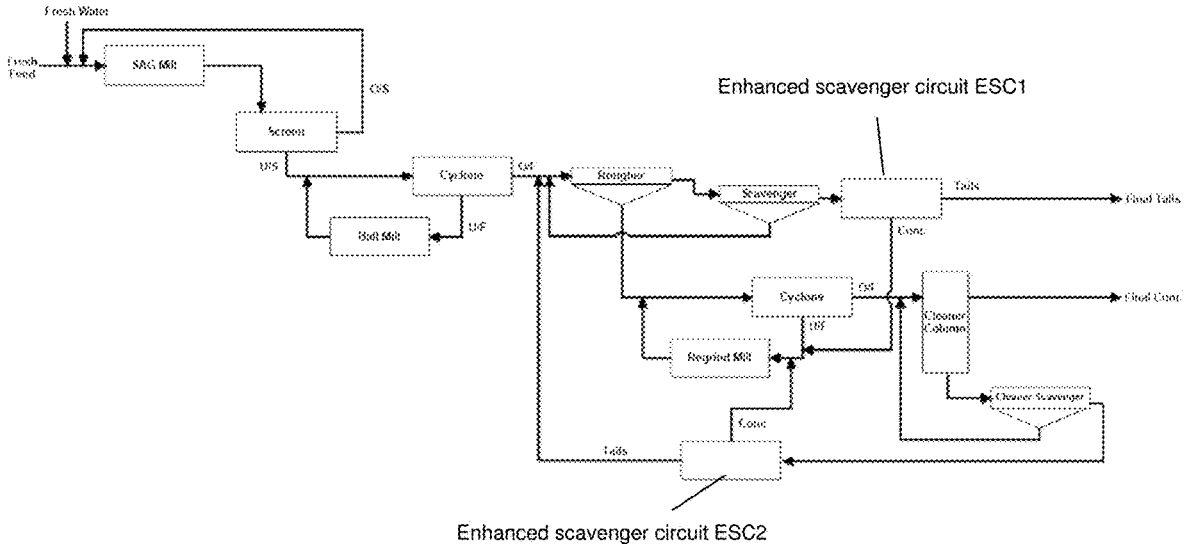
Figure 23: Scavenging circuits for scavenger tails and cleaner scavenger tails with the enhanced scavenging technology

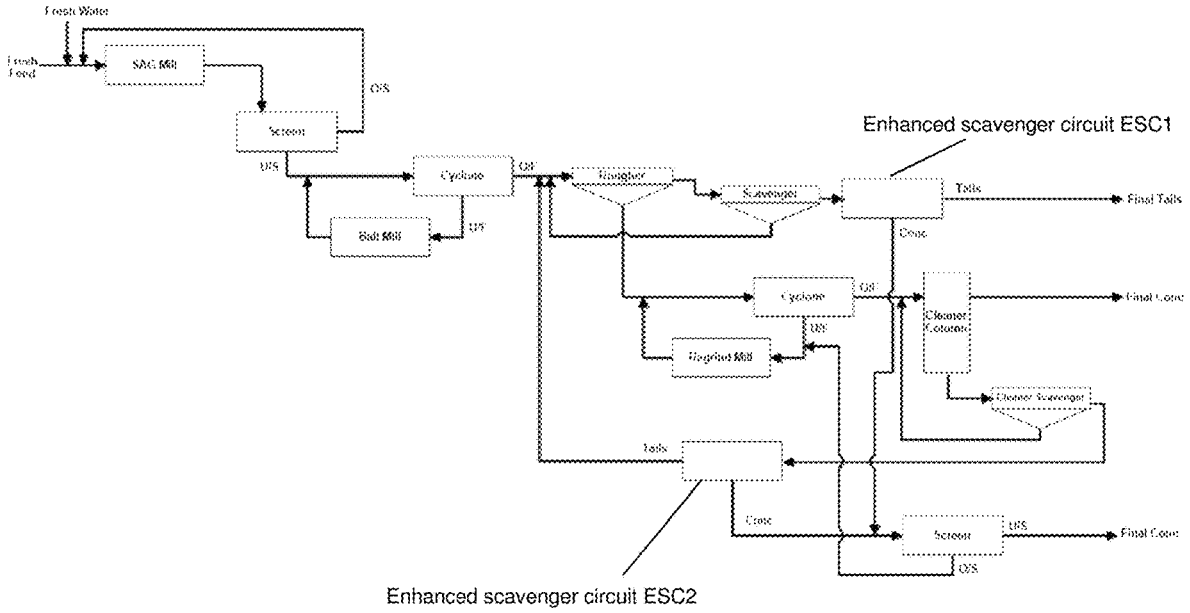
Figure 24: Scavenging circuits for scavenger tails and cleaner scavenger tails in Figure 23 also with screening of the enhanced-scavengering-produced concentrate

PROCESS CONFIGURATIONS TO PREVENT EXCESS REGRINDING OF SCAVENGERING CONCENTRATES

CROSS-REFERENCE TO RELATED PATENT APPLICATIONS

The present application claims the benefit of U.S. Provisional Patent Application No. 62/464,505, filed 28 Feb. 2017, which is incorporated by reference herein in its entirety.

OTHER RELATED APPLICATIONS

This application is also related to a family of nine PCT applications, which were all concurrently filed on 25 May 2012, as follows:

- PCT application no. PCT/US12/39528, entitled "Flotation separation using lightweight synthetic bubbles and beads;"
- PCT application no. PCT/US12/39524, entitled "Mineral separation using functionalized polymer membranes;"
- PCT application no. PCT/US12/39540, entitled "Mineral separation using sized, weighted and magnetized beads;"
- PCT application no. PCT/US12/39576, entitled "Synthetic bubbles/beads functionalized with molecules for attracting or attaching to mineral particles of interest," which corresponds to U.S. Pat. No. 9,352,335;
- PCT application no. PCT/US12/39591, entitled "Method and system for releasing mineral from synthetic bubbles and beads;"
- PCT application no. PCT/US/39596, entitled "Synthetic bubbles and beads having hydrophobic surface;"
- PCT application no. PCT/US/39631, entitled "Mineral separation using functionalized filters and membranes," which corresponds to U.S. Pat. No. 9,302,270;"
- PCT application no. PCT/US12/39655, entitled "Mineral recovery in tailings using functionalized polymers;" and
- PCT application no. PCT/US12/39658, entitled "Techniques for transporting synthetic beads or bubbles In a flotation cell or column," all of which are incorporated by reference in their entirety.

This application is also related to other applications, as follows:

- PCT application no. PCT/US2013/042202, filed 22 May 2013, entitled "Charged engineered polymer beads/bubbles functionalized with molecules for attracting and attaching to mineral particles of interest for flotation separation," which claims the benefit of U.S. Provisional Patent Application No. 61/650,210, filed 22 May 2012;
- PCT/US2014/037823, filed 13 May 2014, entitled "Polymer surfaces having a siloxane functional group," which claims benefit to U.S. Provisional Patent Application No. 61/822,679, filed 13 May 2013, as well as U.S. patent application Ser. No. 14/118,984, filed 27 Jan. 2014, and is a continuation-in-part to PCT application no. PCT/US12/39631 (712-2.385//CCS-0092), filed 25 May 2012;
- PCT application no. PCT/US13/28303, filed 28 Feb. 2013, entitled "Method and system for flotation separation in a magnetically controllable and steerable foam;"

- PCT application no. PCT/US16/57334, filed 17 Oct. 2016, entitled "Opportunities for recovery augmentation process as applied to molybdenum production;" and
- PCT application no. PCT/US16/37322, filed 17 Oct. 2016, entitled "Mineral beneficiation utilizing engineered materials for mineral separation and coarse particle recovery,"
- PCT application no. PCT/US17/37322, filed 9 Jan. 2017, entitled "Recovery media for mineral processing, using open cell or reticulated foam having 3-dimensional functionalized open-network structure for selective separation of mineral particles in an aqueous system,"

which are all also hereby incorporated by reference in its entirety.

All of the aforementioned patent applications are assigned to and owned by the assignee of the instant application.

BACKGROUND OF THE INVENTION

1. Technical Field

This invention relates generally to a method and apparatus for separating valuable material from unwanted material in a mixture, such tailings of a flotation process.

2. Description of Related Art

In many industrial processes, flotation is used to separate valuable or desired material from unwanted material. By way of example, in this process a mixture of water, valuable material, unwanted material, chemicals and air is placed into a flotation cell. The chemicals are used to make the desired material hydrophobic and the air is used to carry the material to the surface of the flotation cell. When the hydrophobic material and the air bubbles collide they become attached to each other. The bubble rises to the surface carrying the desired material with it.

The performance of the flotation cell is dependent on the bubble surface area flux in the collection zone of the cell. The bubble surface area flux is dependent on the size of the bubbles and the air injection rate. Controlling the bubble surface area flux has traditionally been very difficult. This is a multivariable control problem and there are no dependable real time feedback mechanisms to use for control.

Froth flotation is a process for selectively separating hydrophobic materials from hydrophilic. The process has been adapted and applied to a wide variety of materials to be separated, and additional collector agents, including surfactants and synthetic compounds have been adopted for various applications. The flotation process is used for the separation of a large range of sulfides, carbonates and oxides prior to further refinement. Phosphates and coal are also upgraded (purified) by flotation technology. Froth flotation commences by comminution (that is, crushing and grinding), which is used to increase the surface area of the ore for subsequent processing. The ore include the desired minerals and other unwanted materials, know a gangue. The process of grinding the ore into a fine power is known as liberation. The fine powder ore is then mixed with water to form pulp slurry. The desired mineral is rendered hydrophobic by the addition of a surfactant or collector chemical. The particular chemical depends on which mineral is being refined. This slurry (more properly called the pulp) of hydrophobic mineral particles and hydrophilic gangue particles is then placed in a flotation column or horizontal pipeline wherein the concentrated mineral is separated from the tailings containing the gangue. To be effective on a given ore slurry, the collectors are chosen based upon their selective wetting of the types of particles to be separated. A good collector will adsorb, physically or chemically, with one of the types of particles. In a flotation circuit for mineral concentration, various flotation reagents are added to a mixture of ore and water (called pulp) in a conditioning tank. The flow rate and tank size are designed to give the minerals enough time to be activated. The conditioner pulp is fed to a bank of rougher cells which remove most of the desired minerals as a concentrate. The rougher pulp passes to a bank of scavenger cells where additional reagents may be added. The scavenger cell froth is usually returned to the rougher cells for additional treatment, but in some cases may be sent to special cleaner cells. The scavenger pulp is usually barren enough to be discarded as tails. More complex flotation circuits have several sets of cleaner and re-cleaner cells, and intermediate re-grinding of pulp or concentrate. A typical slurry processing system is depicted in FIG. 1. As shown in FIG. 1, pulp slurry 8 is processed through a plurality of flotation cells 10 and the tailings 12 are discarded in a tailings pond or dam 100. If the processed slurry 9 can be further processed for mineral recovery, another flotation cell 10 may be used to repeat the process. When the processed slurry 9 is processed in the last flotation cell 10, froth flotation is generally no longer an effective or viable process for mineral collection. Because of a number of other factors, as much as 15% of the liberated minerals are not recovered and are discarded as gangue in the pond or dam 100.

There is a need in the industry to provide a better way to separate valuable material from unwanted material, from the discarded tailings.

SUMMARY OF THE INVENTION

The Basic Invention

According to some embodiments, the present invention may take the form of a system having a collection processor configured to receive tailings of a flotation process, the tailings having mineral particles of interest; and at least one collection apparatus located in the collection processor. The collection apparatus may include a collection surface configured with a functionalized polymer having a plurality of molecules with a functional group configured to attract the mineral particles of interest to the collection surface. The flotation process may include one or more scavenger circuits configured to provide one or more scavenger circuit feeds having scavenger tails.

The system features one or more enhanced scavenger circuits having the at least one collection apparatus located in the collection processor and being configured to receive the one or more scavenger circuit feeds and provide enhanced scavenger circuit feeds having a first enhanced scavenger circuit feed with enhanced scavenger tails and a second enhanced scavenger circuit feed with enhanced scavenger concentrate for further processing by the system, based upon the at least one collection apparatus located in the collection processor.

The system according to the present invention may include one or more of the features, as follows:

Embodiments Using One Enhanced Scavenger Circuit (ESC)

The one or more scavenger circuits may include a scavenger circuit configured to provide a scavenger circuit feed; and the one or more enhanced scavenger circuits may include an enhanced scavenger circuit configured to receive the scavenger circuit feed and provide the first enhanced scavenger circuit feed as final tails and the second enhanced scavenger circuit feed for further processing by the system.

The flotation process may include a regrind mill configured to receive the second enhanced scavenger circuit feed, and provide a regrind mill feed for further processing by the system.

The flotation process may include a cyclone circuit configured to provide a cyclone U/F circuit feed; and the regrind mill may be configured to receive the cyclone U/F circuit feed, and provide the regrind mill feed for further processing by the system.

The regrind mill may be configured to provide the regrind mill feed to the cyclone circuit for further processing by the cyclone circuit.

The one or more scavenger circuits may include a cleaner scavenger circuit configured to provide a cleaner scavenger circuit feed; and the one or more enhanced scavenger circuits may include an enhanced scavenger circuit configured to receive the cleaner scavenger circuit feed and provide the first enhanced scavenger circuit feed and the second enhanced scavenger circuit feed for further processing by the system.

The flotation process may include a rougher circuit configured to receive the first enhanced scavenger circuit feed and provide a rougher circuit feed for further processing by the system.

The flotation process may include a second scavenger circuit configured to provide a second scavenger circuit feed; and the rougher circuit may be also configured to receive the second scavenger circuit feed and provide the rougher circuit feed for further processing by the system.

The flotation process may include a regrind mill configured to receive the second enhanced scavenger circuit feed, and provide a regrind mill feed for further processing by the system.

The flotation process includes a cyclone circuit configured to provide a cyclone U/F circuit feed; and the regrind mill may be configured to receive the cyclone U/F circuit feed, and provide the regrind mill feed for further processing by the system.

The regrind mill may be configured to provide the regrind mill feed to the cyclone circuit for further processing by the cyclone circuit.

The cyclone circuit may be configured to provide a cyclone O/F circuit feed; and the flotation process may include a cleaner column circuit configured to receive the cyclone O/F circuit feed, and provide a cleaner column circuit feed for further processing by the system.

The cleaner scavenger circuit may be configured to provide a second cleaner scavenger circuit feed; and the cleaner column may be configured to receive the second cleaner scavenger circuit feed and provide the cleaner column feed for further processing by the cleaner scavenger circuit.

The enhanced scavenger circuit may be configured to receive the cleaner scavenger circuit feed and provide the first enhanced scavenger circuit feed and the second enhanced scavenger circuit feed for further processing by the system.

Embodiments Using Two Enhanced Scavenger Circuit (ESCs)

The one or more scavenger circuits may include:

a scavenger circuit configured to provide a scavenger circuit feed, and a cleaner scavenger circuit configured to provide a cleaner scavenger circuit feed; and the one or more enhanced scavenger circuits may include:

a first enhanced scavenger circuit configured to receive the scavenger circuit feed and provide a corresponding first enhanced scavenger circuit feed with corresponding tails and a corresponding second enhanced scavenger circuit feed with corresponding concentrate for further processing by the system; and a second enhanced scavenger circuit configured to receive the cleaner scavenger circuit feed and provide an associated first enhanced scavenger circuit feed with associated tails and an associate second enhanced scavenger circuit feed with associated concentrate for further processing by the system.

The flotation process may include a regrind mill configured to receive the corresponding concentrate, and the associate concentrate, and provide a regrind mill feed for further processing by the system.

The flotation process may include a cyclone circuit configured to provide a cyclone circuit feed; and the regrind mill may be configured to receive the cyclone circuit feed, and provide the regrind mill feed for further processing by the system.

The regrind mill may be configured to provide the regrind mill feed to the cyclone circuit for further processing by the cyclone circuit.

The flotation process may include a rougher circuit configured to receive the associated tails and provide a rougher circuit feed for further processing by the system.

The rougher circuit may be configured to receive a scavenger circuit feed from the scavenger circuit and provide the rougher circuit feed for further processing by the system.

The Screen Circuit Embodiment

The system may include a screen circuit configured to receive the corresponding concentrate and the associate concentrate, and provide screen circuit feeds having a screen circuit U/S feed with a final concentrate and a screen circuit O/S feed for further processing by the process flotation process.

The flotation process may include a regrind mill configured to receive the screen circuit O/S feed, and provide a regrind mill feed for further processing by the system.

The Collection Processor

The functional group may include an ionizing bond for bonding the mineral particles of interest to the molecules.

The synthetic material may be selected from a group consisting of polyamides, polyesters, polyurethanes, phenol-formaldehyde, urea-formaldehyde, melamine-formaldehyde, polyacetal, polyethylene, polyisobutylene, polyacrylonitrile, poly(vinyl chloride), polystyrene, poly(methyl methacrylates), poly(vinyl acetate), poly(vinylidene chloride), polyisoprene, polybutadiene, polyacrylates, poly(carbonate), phenolic resin, and polydimethylsiloxane.

The functional group may be configured to render the collection area hydrophobic.

The synthetic material may be selected from a group consisting of polystyrene, poly(d,l-lactide), poly(dimethylsiloxane), polypropylene, polyacrylic, polyethylene, hydrophobically-modified ethyl hydroxyethyl cellulose polysiloxanates, alkylsilane and fluoroalkylsilane.

The mineral particles of interest may have one or more hydrophobic molecular segments attached thereon, and the tailings have a plurality of molecules, each collector molecule comprising a first end and a second end, the first end comprising the functional group configured to attach to the mineral particles of interest, the second end comprising a hydrophobic molecular segment.

The synthetic material may include a siloxane derivative.

The synthetic material may comprise polysiloxanates or hydroxyl-terminated polydimethylsiloxanes.

The collection surface may be configured to contact the tailings over a period of time for providing an enriched collection surface in the collection apparatus, containing the mineral particles of interest, and the system may also include a release processor configured to receive the collection apparatus having the enriched collection surface, the release processor further configured to provide a release medium for releasing the mineral particles of interest from the enriched collection surface.

The release medium may include a liquid configured to contact with the enriched collection surface, the liquid having a pH value ranging from 0 to 7.

The release medium may include a liquid configured to contact with the enriched collection surface, and the system may also include an ultrasound source configured to apply ultrasound waves to the enriched collection area for releasing the mineral particles of interest from the enriched collection surface.

A part of the collection surface may be configured to have the molecules attached thereto, wherein the molecules comprise collectors. Another part of the collection surface may be configured to be hydrophobic.

A part of the collection surface is configured to be hydrophobic.

Reticulated Foam and/or Foam Block

The at least one collection apparatus may include reticulated foam and/or a reticulated foam block providing the three-dimensional open-cell structure.

The three-dimensional open-cell structure reticulated foam an open cell foam.

The open cell foam may be made from a material or materials selected from a group that includes polyester urethanes, polyether urethanes, reinforced urethanes, composites like PVC coated PU, non-urethanes, as well as metal, ceramic, and carbon fiber foams and hard, porous plastics, in order to enhance mechanical durability.

The open cell foam may be coated with polyvinylchloride, and then coated with a compliant, tacky polymer of low surface energy in order to enhance chemical durability.

The open cell foam may be primed with a high energy primer prior to application of a functionalized polymer coating to increase the adhesion of the functionalized polymer coating to the surface of the open cell foam.

The surface of the open cell foam may be chemically or mechanically abraded to provide "grip points" on the surface for retention of the functionalized polymer coating.

The surface of the open cell foam may be coated with a functionalized polymer coating that covalently bonds to the surface to enhance the adhesion between the functionalized polymer coating and the surface.

The surface of the open cell foam may be coated with a functionalized polymer coating in the form of a compliant, tacky polymer of low surface energy and a thickness selected for capturing certain mineral particles and collecting certain particle sizes, including where thin coatings are selected for collecting proportionally smaller particle size fractions and thick coatings are selected for collecting additional large particle size fractions.

The specific surface area may be configured with a specific number of pores per inch that is determined to target a specific size range of mineral particles in the slurry.

The the at least one collection apparatus may include different open cell foams having different specific surface areas that are blended to recover a specific size distribution of mineral particles in the slurry.

The Method

According to some embodiments, the present invention may include, or take the form of a method for implementing a system having a collection processor configured to receive tailings of a flotation process, the tailings having mineral particles of interest; and at least one collection apparatus located in the collection processor, the collection apparatus having a collection surface configured with a functionalized polymer comprising a plurality of molecules having a functional group configured to attract the mineral particles of interest to the collection surface, the flotation process having one or more scavenger circuits configured to provide one or more scavenger circuit feeds having scavenger tails, wherein the method comprises configuring the system with one or more enhanced scavenger circuits having the at least one collection apparatus located in the collection processor and configured to receive the one or more scavenger circuit feeds and provide enhanced scavenger circuit feeds having a first enhanced scavenger circuit feed with enhanced scavenger tails and a second enhanced scavenger circuit feed with enhanced scavenger concentrate for further processing by the system, based upon the at least one collection apparatus located in the collection processor.

The method may include steps for implementing one or more of the additional features set forth herein.

BRIEF DESCRIPTION OF THE DRAWING

Referring now to the drawing, which are not necessarily drawn to scale, the foregoing and other features and advantages of the present invention will be more fully understood from the following detailed description of illustrative embodiments, taken in conjunction with the accompanying drawing in which like elements are numbered alike:

FIG. 14 includes

FIG. 22 shows an example of a flotation circuit that is known in the art.

FIG. 23 shows the flotation circuit in FIG. 22 having enhanced scavenger circuits included therein, according to some embodiments of the present invention.

FIG. 24 shows the flotation circuit in FIG. 23 having enhanced scavenger circuits included therein, according to some embodiments of the present invention.

DETAILED DESCRIPTION OF THE INVENTION

FIGS. 22-24

Figure 1:
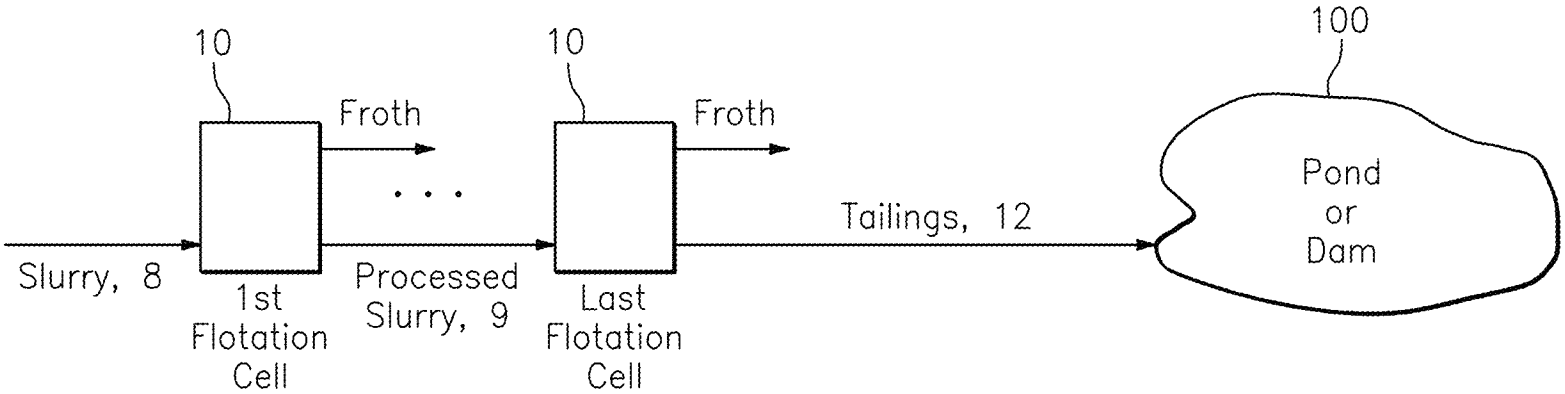
FIG. 1 (PRIOR ART)
FIG. 1 is a diagram of a prior art slurry processing system.

This application builds and improves on technology disclosed in the aforementioned PCT application no. PCT/US12/39655, which corresponds to U.S. patent application Ser. No. 14/119,013, filed 23 Mar. 2015, as well as PCT application no. PCT/US17/37322, which corresponds to U.S. patent application Ser. No. 15/401,755, filed 9 Jan. 2017, which are all incorporated by reference in their entirety.

FIGS. 1-19*b* form part of the aforementioned PCT application no. PCT/US12/39655, FIGS. 20*a* thru 20*d* and 21 form part of PCT application no. PCT/US17/37322, and FIGS. 22-24 form part of the improvement to the aforementioned technology.

In summary, the present invention sets forth an improvement to the use of the assignee's polymer separation technology in a scavenging application to concentrate valuable mineral particles from a stream that would otherwise be discarded or recirculated.

FIG. 22

By way of example, FIG. 22 shows a common process configuration for base metal sulfide processing that is known in the art. In summary, and consistent with that shown in FIG. 22, a flotation circuit receives a fresh feed and water and provides final tails and a final concentrate, as follows:

- A semi-autogenous grinding (SAG) mill is configured to receive a fresh feed, fresh water and an overscreen (O/S) screen feed back from a screen, and provide a SAG mill feed e.g., after further SAG milling the O/S screen feed received from the screen.
- The screen is configured to receive the SAG mill feed, and provide the O/S screen feed back to the SAG mill and an underscreen (U/S) screen feed.
- A cyclone is configured to receive the U/S screen feed and a ball mill feed from a ball mill, and provide an overflow (O/F) cyclone feed and an underflow (U/F) cyclone feed back to the ball mill.
- The ball mill is configured to receive the U/F feed from the cyclone, and provide the ball mill feed back to the cyclone, e.g., after further ball milling the U/F feed received from the cyclone.
- A rougher is configured to receive the O/F feed from the cyclone, a first scavenger feed from a scavenger and a first cleaner scavenger feed from a cleaner scavenger, and provide one rougher feed to the scavenger and another rougher feed to another cyclone.
- The scavenger is configured to receive the one rougher feed from the rougher, and provide the first scavenger feed back to the rougher for further roughening, and a second scavenger feed as final tails.
- The other cyclone is configured to receive the other rougher feed from the rougher and a regrind mill feed from a regrind mill, and provide an overflow (O/F) cyclone feed and an underflow (U/F) cyclone feed back to the regrind mill.
- The regrind mill is configured to receive the U/F cyclone feed from the other cyclone and provide the regrind mill feed back to the other cyclone.
- A cleaner column is configured to receive the O/F cyclone feed from the other cyclone and a second cleaner scavenger feed from the cleaner scavenger, and provide one cleaner column feed as final concentrate and another column cleaner feed back to the cleaner scavenger.

The cleaner scavenger is configured to receive the other column cleaner feed back from the cleaner column, and provide the first cleaner scavenger feed to the rougher and the second cleaner scavenger feed back to the cleaner column.

In this process shown in FIG. 22, the incoming raw materials undergo multiple stages of size reduction along with multiple stages of separation in order to produce a final product of suitable purity. It should be understood that the configuration shown here in FIG. 22 is only exemplary and the present invention should be suitable for any similar process in which the size reduction steps can consist of one or more of the following: crushers; rod mills; ball mills; semi-autogenous grinding mills; autogenous grinding mills; high pressure grinding rolls; vertically stirred mills; horizontal fine grinding mills; or any other similar size reduction technology. Similarly the separation steps/stages shown in FIG. 20 may consist of one or more of the following: mechanical flotation; column cell flotation; impinging jet flotation systems (contact cell, Jameson cell, microcell); permanent magnetic separators; electromagnetic separators; gravity separation equipment; enhanced gravity separators (See works related to continuous concentrators and mineral separation systems related to Falcon, Knelson, MGS, Kelsey, Jig, etc.); electrostatic separators; or any other similar mineral separation equipment. Finally it should also be understood that screening or cyclone stages shown in FIG. 22 are exemplary of classification processes and may consist of one or more of the following: hydrocylones; wet screens; dry screens; or any other similar classification technology for minerals.

The new technology according to the present invention is able to selectively concentrate value mineral particles from tailings streams in mineral processing plants which would otherwise be unrecoverable due to issues with particle size, mineral associations, mineral liberation or mineral surface exposure. Details of this application of the scavenger technology have been disclosed previously (See the aforementioned PCT application no. PCT/US12/39655, set forth in the family of the assignee's cases herein). A key process step in many beneficiation processes is the regrind stage (FIG. 22) where particles containing value minerals which are initially recovered by a given separation technology undergo further size reduction to improve the liberation and surface exposure of the value minerals. The products of regrinding stages can then be more selectively upgraded (e.g. the cleaner column stage in FIG. 22) to produce final products with acceptably high concentrations of value minerals.

Regrinding steps may also be used for the products of scavenging separation stages (FIG. 22) whose goal is to prevent recoverable value mineral particles from exiting the plant in final waste streams. Particles recovered in these scavenging steps often possess non-optimal particle characteristics (particle size/liberation/surface exposure) for recovery. Therefore, simply recirculating these particles from scavenging stages to rougher separation stages without the possibility of further size reduction would only serve to generate undesirable circulating loads in separation circuits. It is for this reason that particles recovered from scavenging stages will be fed directly or indirectly to a regrinding step.

In the case of the new tailings scavenging technology, examples of embodiments/applications according to the present invention are shown in FIG. 23 as added processes to the flotation circuit in the flowsheet shown in FIG. 22.

FIG. 23

In particular, according to some embodiments of the present invention, the flotation circuit in FIG. 23 may be configured with a first enhanced scavenger circuit ESC1 after the scavenger circuit for further processing scavenger tails or tailings. The ESC1 may be configured to receive the second scavenger feed, and provide a first ESC1 feed (tails) as the final tails and a second ESC1 feed (conc) as ESC1 concentrate back to the regrind mill for further regrinding. Moreover, according to some embodiments of the present invention, the flotation circuit in FIG. 23 may also be configured with a second enhanced scavenger circuit ESC2 after the cleaner scavenger circuit for further processing cleaner scavenger tailings. The ESC2 may be configured to receive the first cleaner scavenger feed, provide a first ESC2 feed (tails) as the tails back to the rougher for further processing, and also provide a second ESCs feed (conc) as ESC2 concentrate back to the regrind mill for further regrinding. In this case, the rougher may be configured to receive the O/F feed from the cyclone, the first scavenger feed from the scavenger and the first ESC2 feed (tails) as the tails from the ESC2, and provide the one rougher feed to the scavenger and the other rougher feed to the other cyclone. In addition, in this case, the regrind mill may be configured to receive the U/F cyclone feed from the other cyclone, the second ESC1 feed (conc) as the ESC1 concentrate and the second ESC2 feed (conc) as the ESC2 concentrate, and provide the regrind mill feed back to the other cyclone for further processing.

In FIG. 23, the ESC1 and ESC 2 may be configured to further treat and process the tailings of rougher-scavenger flotation as well as the tailings of the cleaner-scavenger flotation. FIG. 23 shows the concentrates produced from the ESC1 and ESC2 as being fed directly to the regrinding step. This would be expected to ultimately lead to increased value mineral recovery in the final concentrate from the cleaner column in FIG. 23 and therefore have a positive economic benefit for the overall plant.

However, one negative aspect of the flotation circuit shown in FIG. 23 is that well-liberated, finely sized value mineral particles in the ESC-produced concentrate (likely not recovered by the existing separation circuits because of particle size effects rather than liberation/locking issues) may not likely benefit from regrinding. This process step would reasonably be expected to either reduce the particle size needlessly, or may have no effect as fine sized particles recirculated to a regrind mill's cyclone feed would likely report to the cyclone underflow and effectively short-circuit the regrinding step entirely. This may be undesirable as the regrinding of the fine particles in the ESC concentrate would not result in an increased probability of these particles reporting to the plant's final concentrate (cleaner column concentrate in FIG. 23).

FIG. 24

In view of this, some embodiments of the present invention may be geared towards addressing this issue, e.g., by employing additional classification steps for the ESC-produced concentrates as shown in FIG. 24.

In particular, according to some embodiments of the present invention, the flotation circuit shown in FIG. 23 may also be configured with a second screen as shown in FIG. 24. In this case, the second screen may be configured to receive the second ESC1 feed (conc) as the ESC1 concentrate and also receive the second ESC2 feed (conc) as the ESC2 concentrate, and provide a second screen U/S feed as a final concentrate (final conc), and also provide a second screen O/S feed back to the regrind mill for further processing. In this embodiment, the flotation circuit in FIG. 24 is configured so that the second ESC1 feed (conc) as the ESC1 concentrate and the second ESC2 feed (conc) as the ESC2 concentrate are not provided directly back to the regrind mill, but instead are provided to the second screen. In this case, the regrind mill may be configured to receive the U/F cyclone feed from the other cyclone and the second screen O/S feed from the second screen, and provide the regrind mill feed back to the other cyclone for further processing.

Many valuable minerals show preferential deportment to finer size classes relative to common gangue minerals (often silicates) so it is reasonable to expect a significant amount of the valuable minerals in the assignee's circuit feeds (FIG. 24) to be in very fine size classes. The classification stage shown in FIG. 24 may therefore be able to produce a secondary concentrate that could be fed to downstream refining processes or blended with the main plant concentrate product. This process configuration would minimize the contribution of the ESC1/2's concentrates to regrind stage feed rates and therefore minimize plant disruptions due to the introduction of the assignee's mineral separation technology in an operating mineral processing plant.

The Implementation of the ESC1 and ESC2

Consistent with that disclosed in the aforementioned PCT application no. PCT/US12/39655, the ESC1 and ESC2 according to the present invention may be implement using one or more of the combinations of technology disclosed in relation to FIGS. 2*a* through 19*b*, as follows:

FIG. 2*a*-2*d*: Tailings Processing

By way of example, tailings from a flotation process can be processed in a tailings pond or in a location between the end of the flotation process and the tailings pond. According to some embodiments of the present invention, a method or technique is provided to recover a valuable material or mineral particle of interest in, or that form part of, the tailings, using collection apparatus that may be functionalized with a synthetic material comprising a plurality of molecules having a functional group configured to attract the mineral particles of interest to the surface of the collection apparatus. The method or technique includes causing the collection apparatus to contact with the tailings having the mineral particles of interest, including the tailings from a flotation process. Numerous techniques or ways are set forth herein for causing the collection apparatus to contact with the tailings.

According to some embodiments of the present invention, the functional group may include an ionizing bond for bonding the mineral particles to the molecules. According to some embodiments of the present invention, the functional group may render the collection area or surface hydrophobic in order to attract hydrophobic mineral particles of interest. In the specification, the terms "functionalized synthetic material", "synthetic material" and "functionalized polymer" are used interchangeably. The terms "valuable material", "valuable mineral" and "mineral particles of interest" are also used interchangeably. The term "polymer" means a large molecule made of many units of the same or similar structure linked together.

Figure 2A:
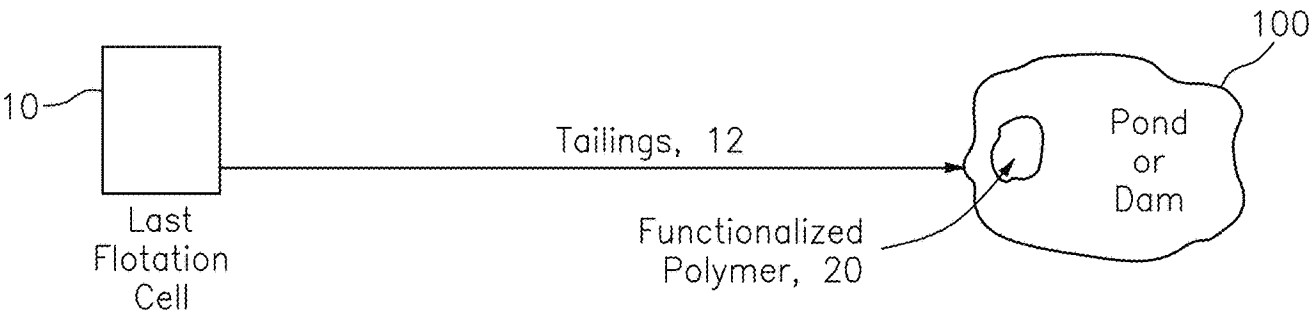
FIGS. 2*a*-2*d* are diagrams of an overall scheme for tailings processing, according to some embodiments of the present invention.

In the embodiment as shown in FIG. 2*a*, after the tailings 12 is discharged from a last flotation cell 10 to a tailings pond or dam 100, a functionalized polymer 20 may be placed in the tailings pond to collect the valuable material of interest in the pond.

Figure 2B:
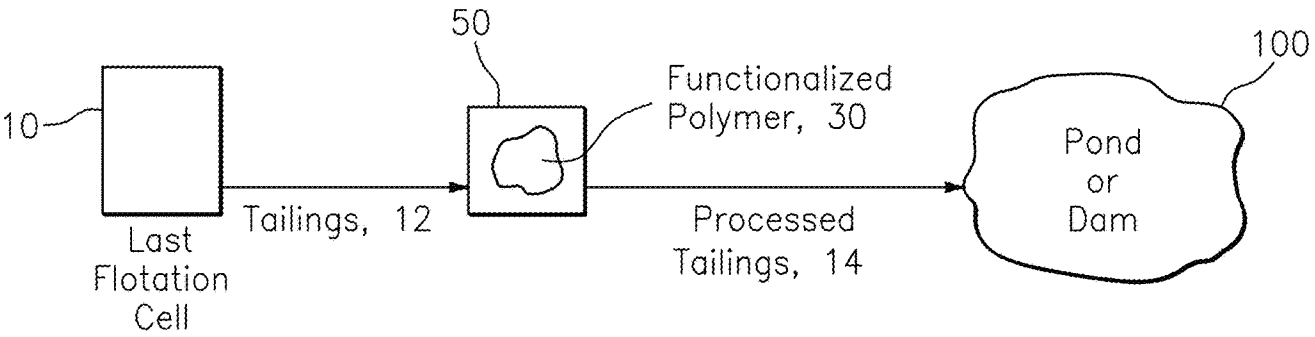

In the embodiment as shown in FIG. 2*b*, a functionalized polymer 30 may be used in a recovery processor 50 located closed to the last flotation cell 10 to process the tailings 12 in order to collect the valuable material of interest in the recovery processor 50. The processed tailings 14 are then transported to the pond or dam 100.

Figure 2C:
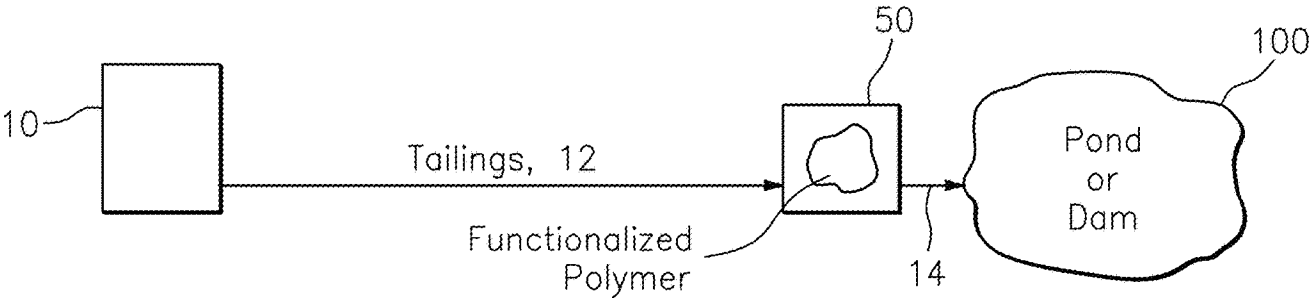

In the embodiment as shown in FIG. 2*c*, the recovery processor 50 may be placed near the pond 100. The recovery processor 50 may use the functionalized polymer 30 to process the tailings 12. The processed tailings 14 may then be discharged into the pond or dam 100.

Figure 2D:
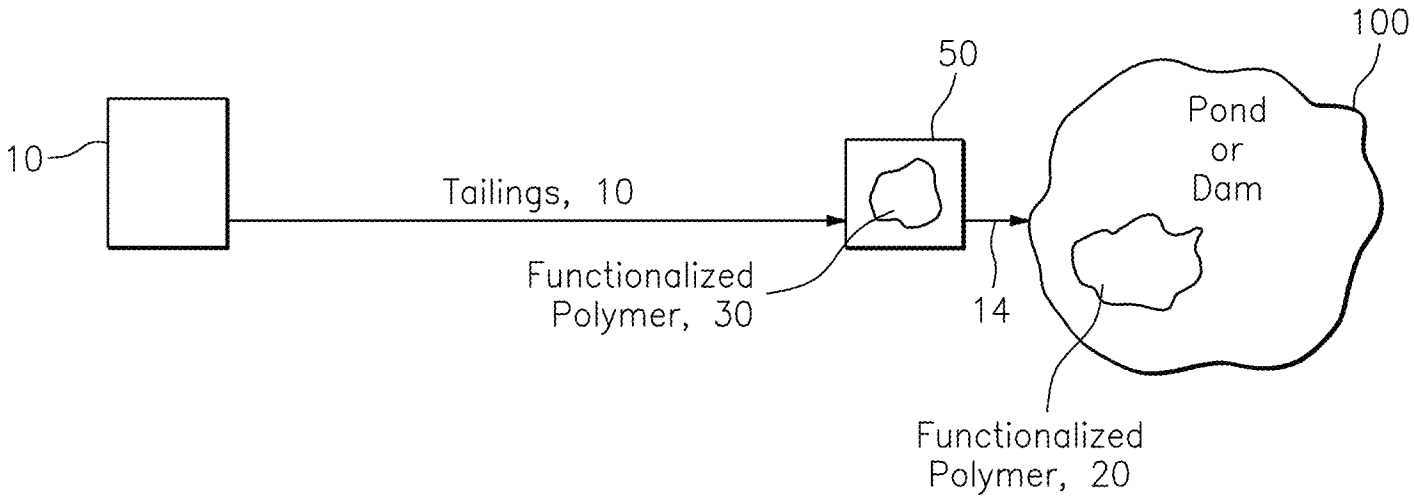

In the embodiment as shown in FIG. 2*d*, the functionalized polymer 30 may be used to collect the mineral particle of interest in the recovery processor 50 and the functionalized polymer 20 may be used in the pond 100.

By way of example, the functionalized polymer 20, 30 may comprise functionalized polymer coated collection areas or surfaces as shown in FIGS. 3*a*-3*c*, 5*a*-5*c*, 6*a*-6*d*, 7*a*-7*f*, 8*a*-9*c*, 11*a*, 12*a*.

Figure 3A:
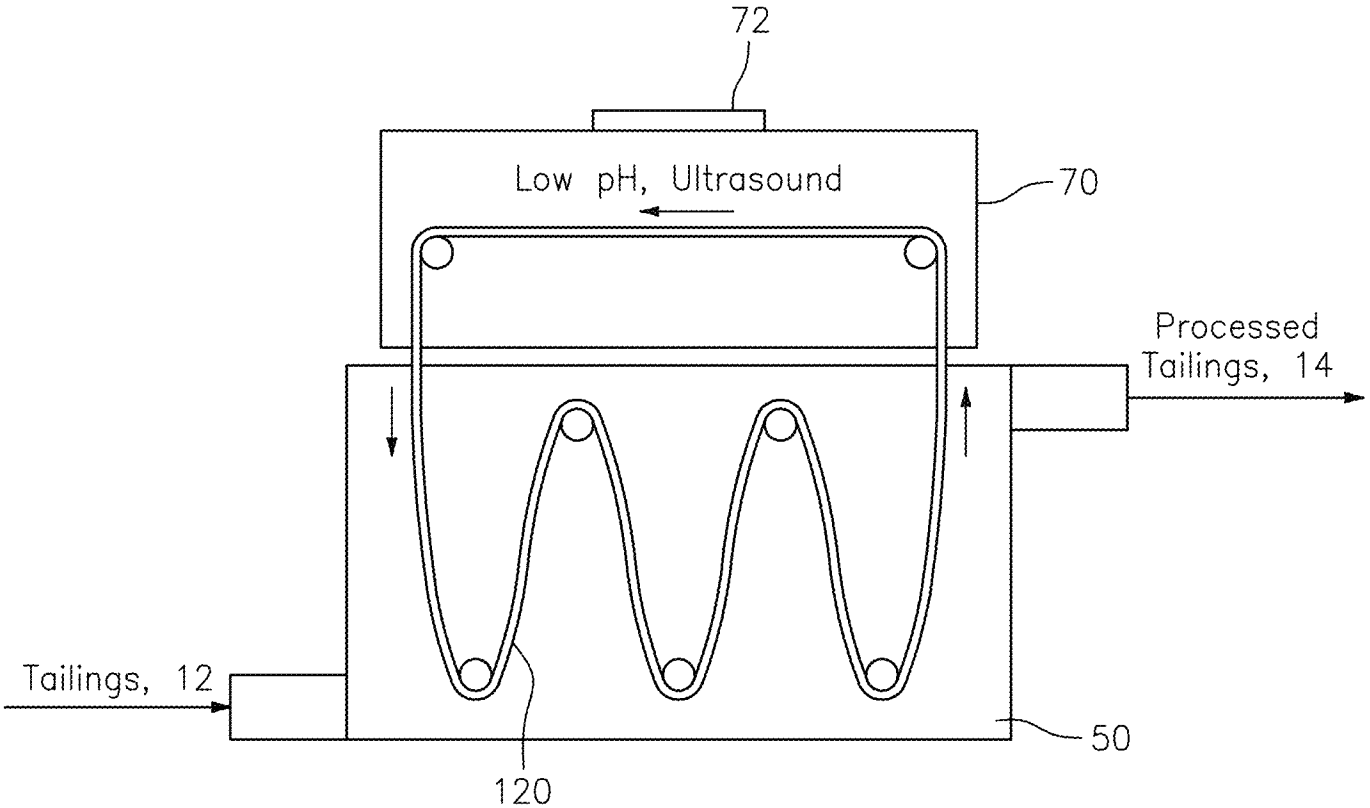
FIG. 3*a* is a diagram of a recovery processor configured with a functionalized polymer coated conveyor belt operated in conjunction with a releasing processor, according to some embodiments of the present invention.
Figure 3B:
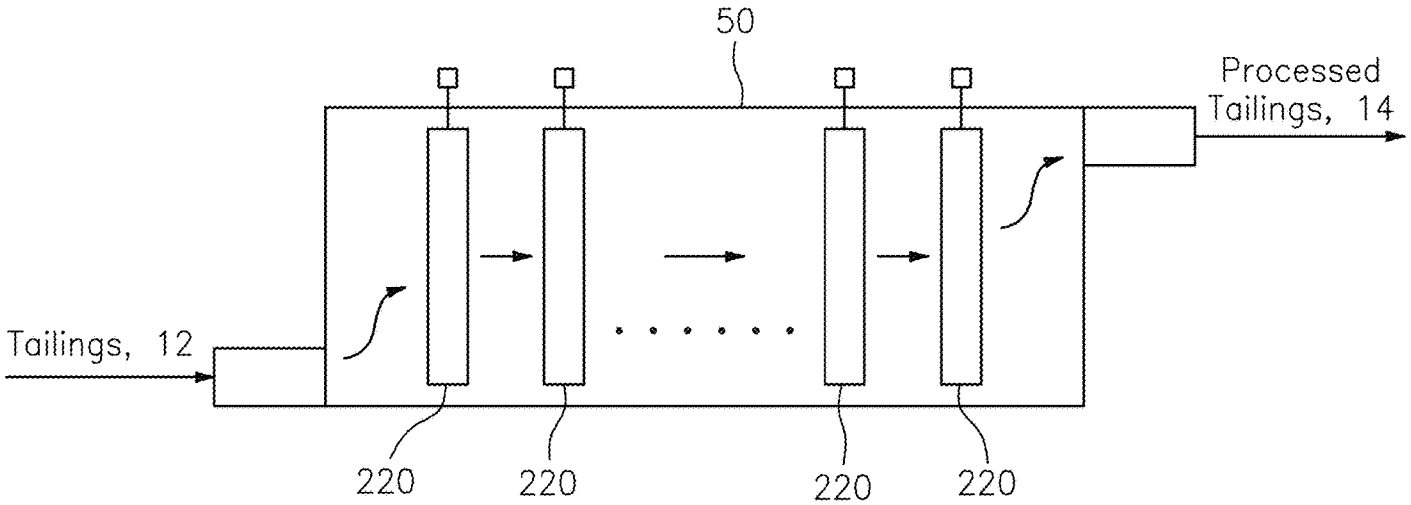
FIG. 3*b* is a diagram of a recovery processor configured with a plurality of filters having functionalized polymer surfaces for collecting valuable material in a batch process, according to some embodiments of the present invention.
Figure 3C:
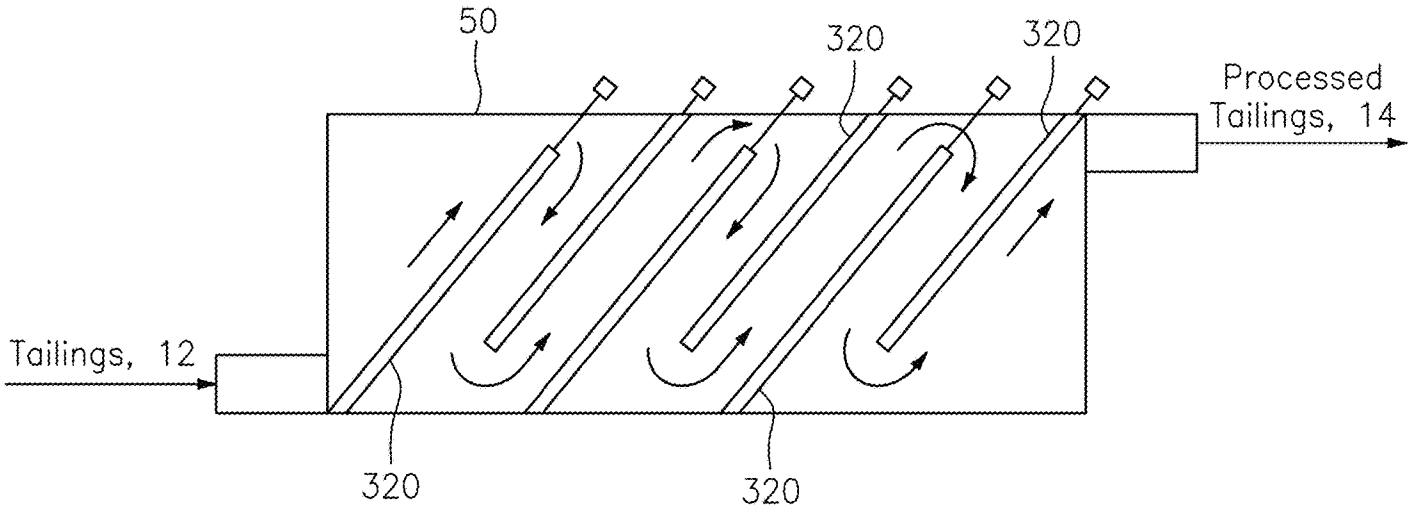
FIG. 3*c* is a diagram of a recovery processor configured with a plurality of collection plates having functionalized polymer surfaces for collecting valuable material in a batch process, according to some embodiments of the present invention.

FIGS. 3*a*-3*c*: Functionalized Polymer in Recovery Processor

By way of example, the functionalized polymer 30 (FIGS. 2*c*-2*d*), according to some embodiments, may be provided on a collection apparatus in the recovery processor. The collection apparatus may include a collection area or surface coated with the functionalized polymer. The collection apparatus can take many different forms, and the scope of the invention is not intended to be limited to any particular type or kind thereof, either now known or later developed in the future. For example, the collection apparatus can take the form of a conveyor belt, a filter and a collection plate.

In the embodiment as shown in FIG. 3*a*, one or both sides of the conveyor belt 120 may be coated with, or made of, the functionalized polymer. As tailings 12 may be received into the recovery processor 50, the tailings are caused to contact with the surfaces of the conveyor belt 120, which is moving in a continuous loop between the recovery processor 50 and a release processor 70. The valuable material or mineral particle of interest attached to the surfaces of the conveyor belt 120 in the recovery processor 50 will be released from the conveyor belt in the release processor 70 by means of a low pH environment and/or by means of ultrasonic agitation. As shown in FIG. 3*a*, one or more ultrasound sources 72 may be provided in the release processor 70 in order to apply ultrasonic agitation to the surfaces of the conveyor belt. The pH value in the release processor can be ranged from 0 to 7. After being processed in the recovery processor 50, the processed tailings 14 can be transported to a tailings pond or directly discharged into a tailings pond. Alternatively, the processed tailings 14 can be received into another recovery processor 50 for further processing.

In the embodiment as shown in FIG. 3*b*, a plurality of filters 220 may be used in a group. Each of the filters 220 may have a plurality of passage ways (see FIGS. 7*a*-7*e*) to allow the tailings 12 to move through. The passage ways may be used to provide collection areas or surfaces (see FIGS. 8*a*-9*c*) configured to contact with the tailings as the tailings pass through the passage ways. The collection areas or surfaces in the passage ways may be coated with, or made of, the functionalized polymer. As the tailings move from one end of the recovery processor 50 to the other end through the filters 220, the molecules of the functionalized polymer are configured to attract the mineral particles of interest in the tailings. When the filters 220 have collected a certain amount of mineral particles of interest, one or some of the filters 220 can be removed from the recovery processor 50 at a time in order to release the mineral particles collected on the filters.

Figure 4:
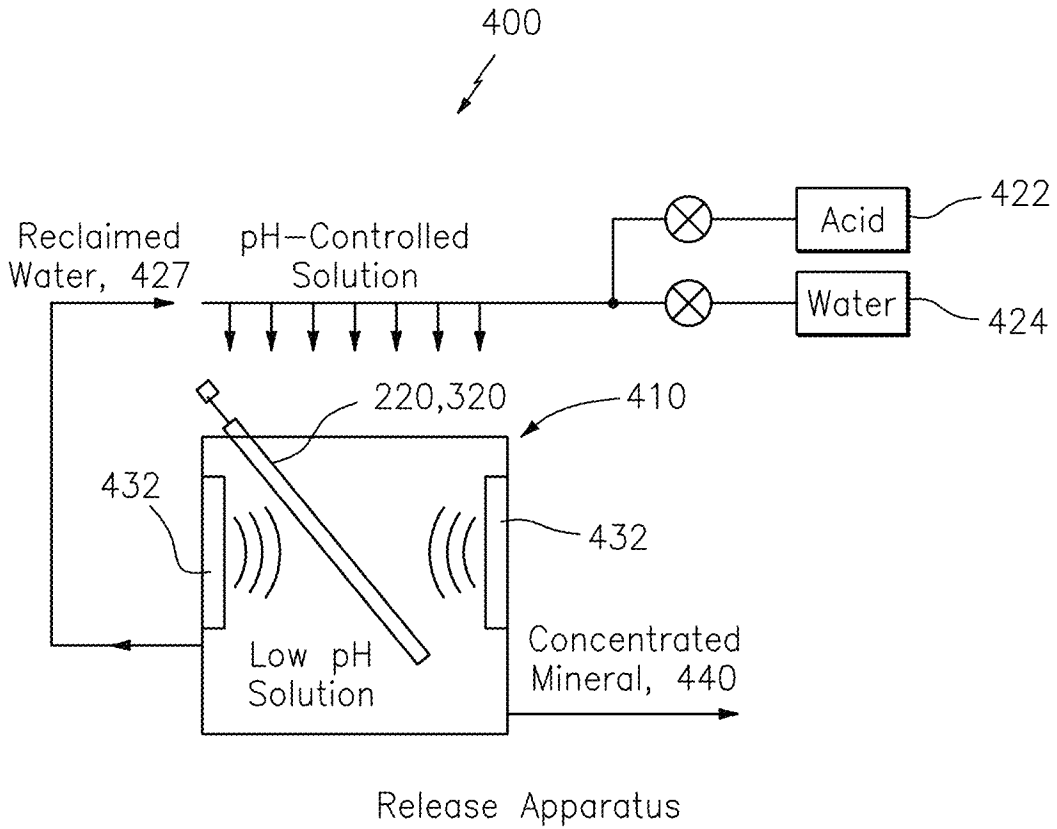
FIG. 4 is a diagram of a releasing processor, according to some embodiments of the present invention.

In the embodiment as shown in FIG. 3*c*, a plurality of collection plates 320 may be arranged in a certain pattern to increase the contact between the tailings in the recovery processor 50 and the collection plates 320. Each of the collection plate 320 may be coated with, or made of, the functionalized polymer. As the tailings move from one end of the recovery processor 50 to the other end through the collection plates 320, the molecules of the functionalized polymer are configured to attract the mineral particles of interest in the tailings. When the collection plates 320 have collected a certain amount of mineral particles, one or some of the collection plates 320 can be removed from the recovery processor 50 at a time in order to release the mineral particles collected on the collection plate. The mineral particles attached to the filters 220 or the collection plates 320 can be released in many different ways. For example, they can be released in a low pH environment, by ultrasonic agitation, by microwaves, by ultraviolet light illumination or thermally. By way of example, a filter 220 or collection plate 320 with collected mineral particles can be taken to a release station 400 as shown in FIG. 4. The filter 200 or collection plate may be placed in a release apparatus 410 to be washed with a mixture of acid and water provided by water container 424 and acid container 422. One or more ultrasonic sources 432 may be used to shake loose the attached mineral particles from the filter 220 or collection plate 230. The reclaimed water 427 can be channeled back for reuse. The concentrated mineral 440 can be taken out of the releasing apparatus 410.

Figure 5C:
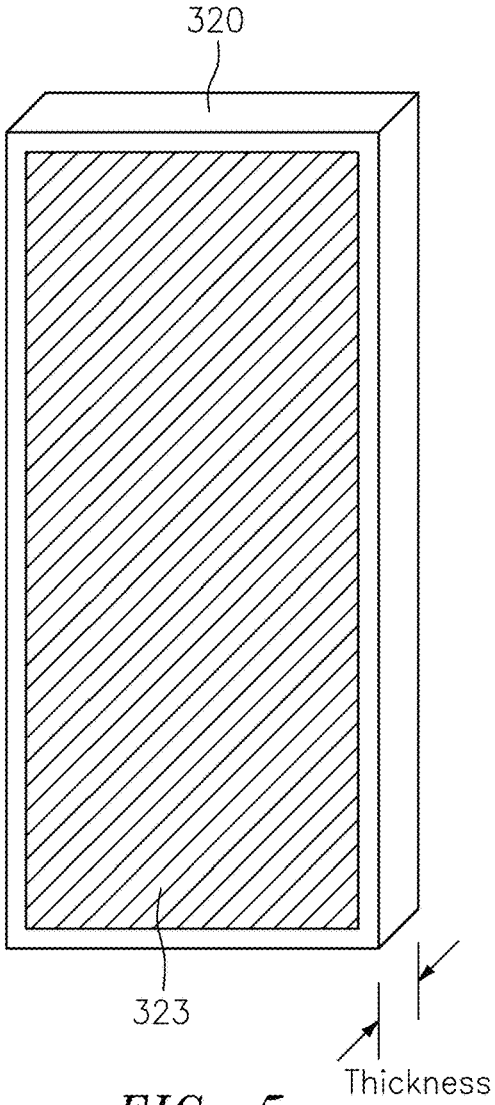
FIG. 5*c* is an illustration of a collection plate, according to some embodiments of the present invention.
Figure 5A:
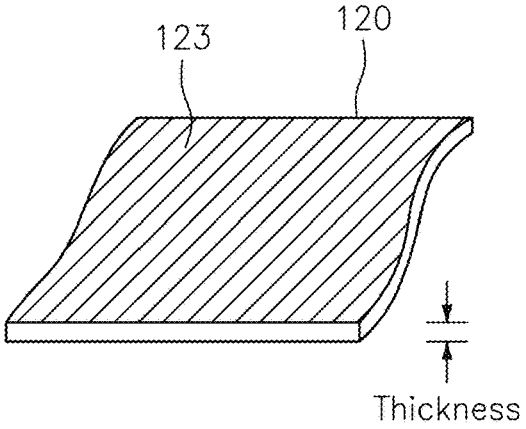
FIG. 5*a* is an illustration of a section of a conveyor belt, according to some embodiments of the present invention.
Figure 5B:
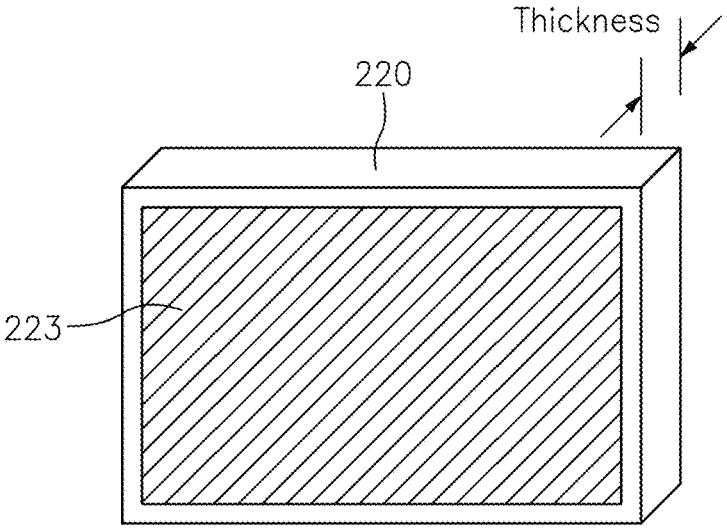
FIG. 5*b* is an illustration of a filter, according to some embodiments of the present invention.

FIGS. 5*a*, 5*b* and 5*c*: Conveyor Belts, Filters and Collection Plates By way of example, the conveyor belt 120 (FIG. 3*a*) may be configured with a collection area 123 to support the functionalized polymer (FIG. 5*a*). The filter 220 (FIG. 3*b*) may be configured with a collection area 223 to support the functional polymer (FIG. 5*b*). The collection plate 320 (FIG. 3*c*) may be configured with a collection area 323 to support the functionalized polymer (FIG. 5*c*). The collection area 123, 223 and 323 can take many forms and have various surface features (FIGS. 7*a*-7*f*) to collect the mineral particles of interest, when the conveyor belt 120, the filter 220 and the collection plate 320 are made to contact with the tailings, whether in a tailings pond 100 (FIGS. 2*a*-2*d*) or in recovery processor 50 (FIGS. 2*b*-2*d*, 3*a*-3*c*).

FIGS. 6*a*-6*d*: Surface Structures

Figure 6A:
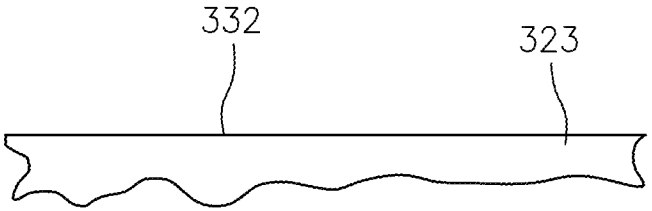
FIGS. 6*a*-6*d* illustrate various surface features of the collection plate, according to some embodiments of the present invention.
Figure 6B:
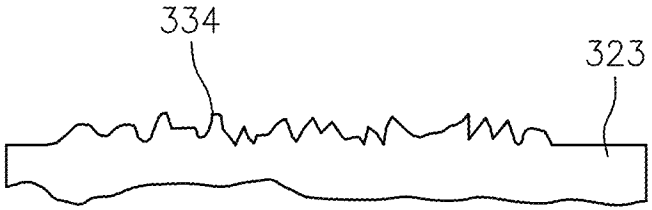
Figure 6C:
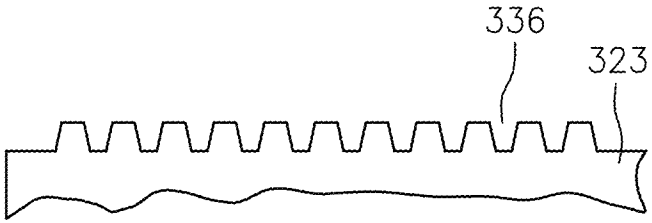
Figure 6D:
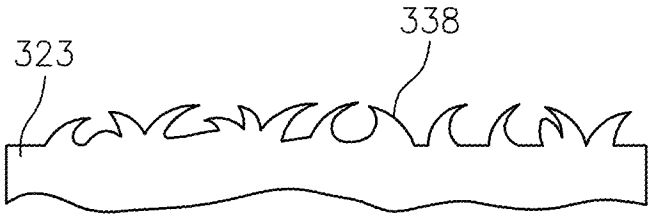

The collection area 323 of the collection plate 320 can take many different forms. For example, the collection area 323 on one or both of sides of the collection plate 323 can be a smooth surface, as shown in FIG. 6*a*. The collection area 323 on one or both of sides of the collection plate 323 can be a rough surface of irregular height and pattern, as shown in FIG. 6*b*. The collection area 323 on one or both of sides of the collection plate 323 can have grooves and dents, as shown in FIG. 6*c*. The collection area 323 on one or both of sides of the collection plate 323 can have hair-like structure as shown in FIG. 6*d*. The collection area may be coated with, or made of, functionalized polymer to attract mineral particles of interest. The surface structures on FIGS. 6*b*-6*d* may be configured to increase the contact between the functionalized polymer on the collection area and the tailings.

FIGS. 7*a*-7*f*: Surface Features

Figure 7A:
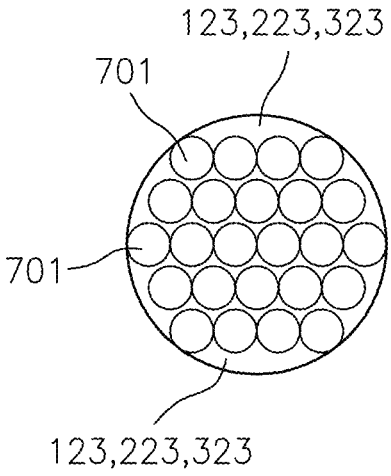
FIGS. 7*a*-7*f* illustrate various surface features of the filter and the conveyor belt, according to some embodiments of the present invention.
Figure 7B:
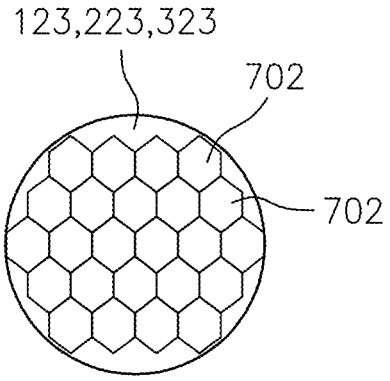
Figure 7C:
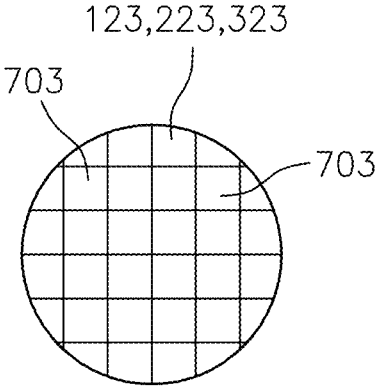
Figure 7D:
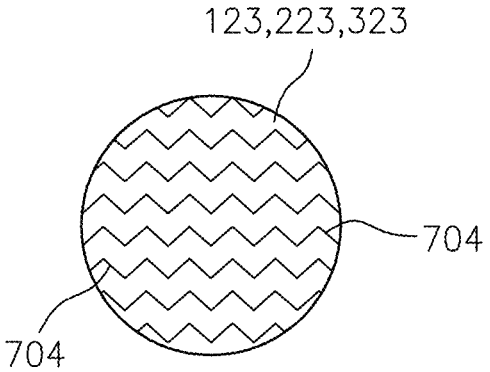
Figure 7E:
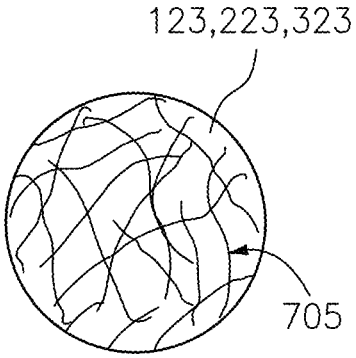
Figure 7F:
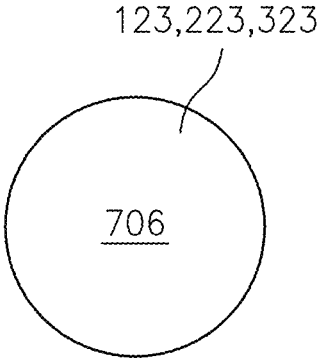

By way of example, each of the collection areas 123, 223 and 323 (FIGS. 5*a*-5*c*) may have a plurality of openings to allow the tailings 12 (FIGS. 3*a*-3*c*) to pass through while collecting at least part of the valuable material or mineral particles of interest in the tailings. The surface inside an opening and the surfaces or edges around the opening may be provided with the molecules of the functionalized polymer to attract the mineral particles. Those surfaces are referred to as collection surfaces. For example, the openings on the collection areas 123, 223 and 323 can take the form of holes or cylindrical passage ways 701 as shown in FIG. 7*a*. The openings on the collection areas 123, 223 and 323 can take the form of hexagonal passage ways 702 arranged like honeycomb, as shown in FIG. 7*b*. The collection areas 123, 223 and 323 can have a rectangular grid 703, as shown in FIG. 7*c*. The collection areas 123, 223 and 323 may comprise a stack of wavy sheets 704 a shown in FIG. 7*d*. The collection areas 123, 223 and 323 may comprise an irregular arrangement of fiber-like structures 705 as shown in FIG. 7*e*. The collection areas 123 and 323 may comprise a plain surface 706 as shown in FIG. 7*f*. The plain surface 706 may be a smooth surface, a paper-like surface or matted surface, without larger structures. The collection area 23, 123 and 223 can be made of a synthetic material, such as a polymer functionalized for attracting the mineral particles. Alternatively, only the collection surfaces may be coated with such a functionalized polymer while most part of the conveyor belt 120, the filter 220 and the collection plate 320 may be made of metal, ceramic, glass or a different polymer.

FIGS. 8*a*-9*c*: Surface Molecules

Figure 8C:
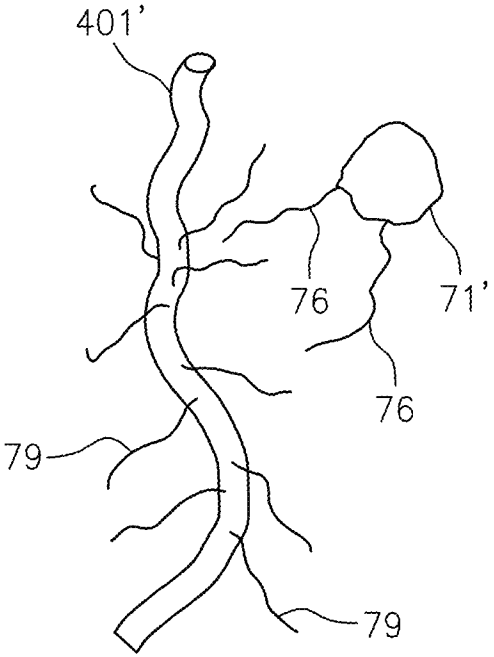
FIG. 8*c* illustrates a plurality of hydrophobic molecules attached to a fiber for attracting non-mineral particles, according to some embodiments of the present invention.
Figure 8B:
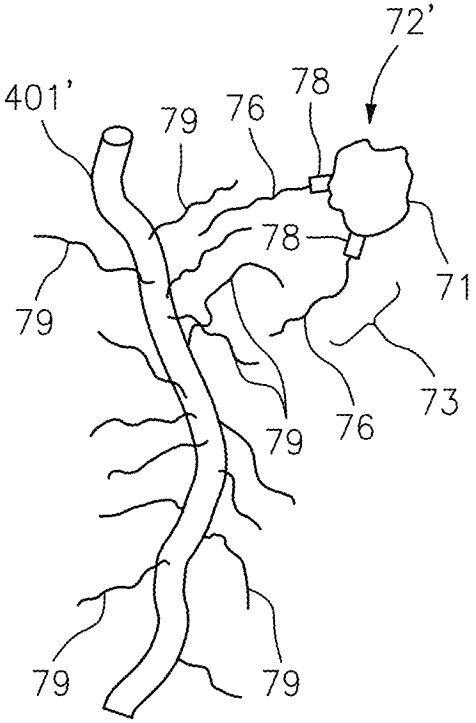
FIG. 8*b* illustrates a plurality of hydrophobic molecules attached to a fiber for attracting mineral particles, according to some embodiments of the present invention.
Figure 8A:
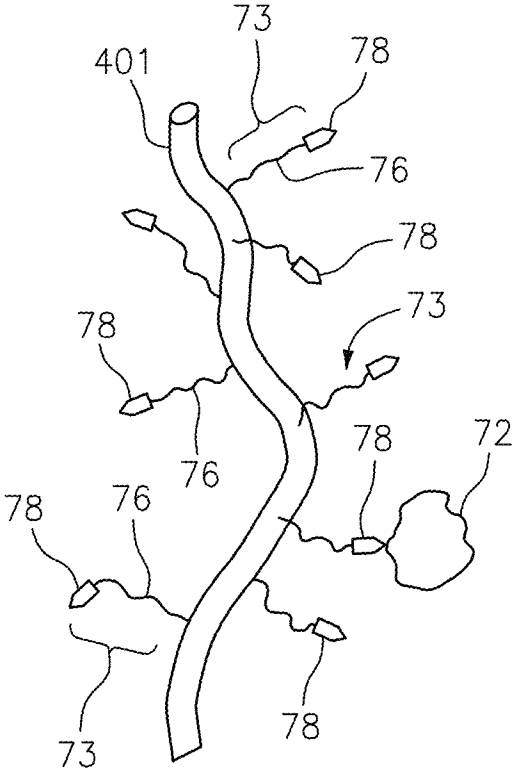
FIG. 8*a* illustrates a plurality of functional groups attached to a fiber for attracting mineral particles, according to some embodiments of the present invention.

By way of example, the fiber-like structures 705 (FIG. 7*e*) can be functionalized so that they become attached to molecules 73 (FIGS. 8*a*, 8*b*). The fiber-like structures 705 as shown in FIG. 7*e* can be made of individual fibers 401, 401' as shown in FIG. 8*a*-8*c*. In one embodiment of the present invention, the fiber 401 (FIG. 8*a*) can be made of a polymer that has a plurality of molecules 73 to provide the functional group 78 and the attaching molecular segment 76. A xanthate, for example, has both the functional group 78 and the molecular segment 76 to be incorporated into the polymer that is used to make the fiber 401. A functional group 78 is also known as a collector that is either ionic or non-ionic bonding to mineral particles 72. The ion can be anionic or cationic. An anion includes, but not limited to, oxyhydryl, such as carboxylic, sulfates and sulfonates, and sulfhydral, such as xanthates and dithiophosphates. Other molecules or compounds that can be used to provide the function group 78 include thionocarboamates, thioureas, xanthogens, monothiophosphates, hydroquinones and polyamines. In another embodiment of the present invention, the fiber 401 is coated with polymer that has the molecules 73 to provide the functional group 78 and the attaching molecular segment 76. With such a coating, the fiber 401 can be made of glass, ceramic, metal, nylon, cotton or a different polymer. A diagram of the fiber 401 and the attached molecules 73 is shown in FIG. 8*a*.

In a different embodiment of the present invention, the fiber 401' (FIG. 8*b*) can be made of a polymer that has a plurality of molecules 79 to render the fiber 401' (and thus the collection areas 123, 223 and 323 of FIGS. 5*a*-5*c*) hydrophobic. The polymer can be a hydrophobic material such as polystyrene, poly(d,l-lactide), poly(dimethylsiloxane), polypropylene, polyacrylic, polyethylene, etc. The polymer can also be a hydrophobically-modified polymer, such as hydrophobically-modified ethyl hydroxyethyl cellulose. Alternatively, the fiber 401' can be made of glass, ceramic, metal, nylon, cotton or other fabric materials and coated with hydrophobic molecules, such as polysiloxanates, alkylsilane and fluoroalkylsilane. The molecules 79 cause the fiber 401' to become hydrophobic. As such, a hydrophobically-modified mineral particle 72' can be attracted to the hydrophobic fiber 401'. The hydrophobically-modified, or wetted, mineral particle 72' may include a mineral particle 71 and one or more molecules 73 attached thereon. The molecule 73, or collector, may have a functional group 78 attached to the mineral particle 71 and a hydrophobic chain or molecular segment 76. A diagram showing the attraction between the hydrophobic chain or molecular segments 76 and the hydrophobic fiber 401' is shown in FIG. 8*b*. It should be understood that the particles 72' may be non-mineral and can be some harmful particles in a body of water. Furthermore, the hydrophobic fiber 401' can also be used to attract non-mineral particles. For example, if a non-mineral particle 71' has one or more hydrophobic chains or molecular segments 76, the non-mineral particle 71' may also attracted to the hydrophobic fiber 401'. A diagram showing the attraction between non-mineral particles 71' and the hydrophobic fiber 401' is shown in FIG. 8*c*. Thus, the hydrophobic fiber 401' can be used in a filter, impeller or conveyor belt (similar to those shown in FIGS. 4-6) for water-pollution control, water purification, etc.

Figure 9A:
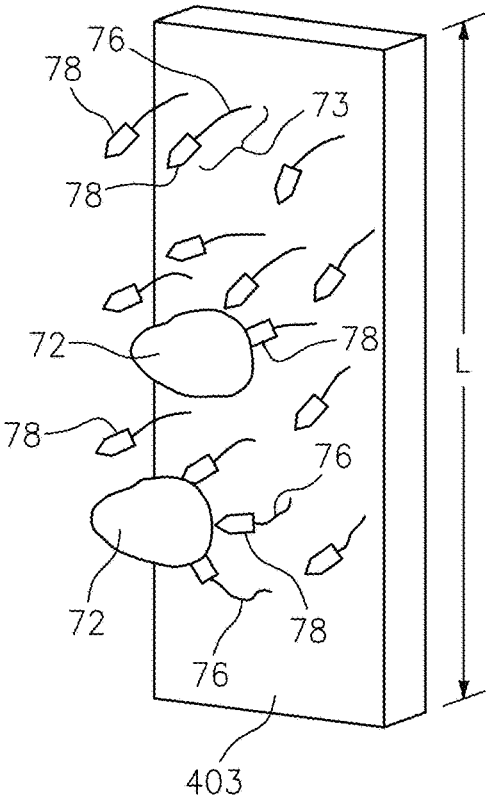
FIG. 9*a* illustrates a plurality of functional groups attached to edges or surfaces for attracting mineral particles, according to some embodiments of the present invention.
Figure 9C:
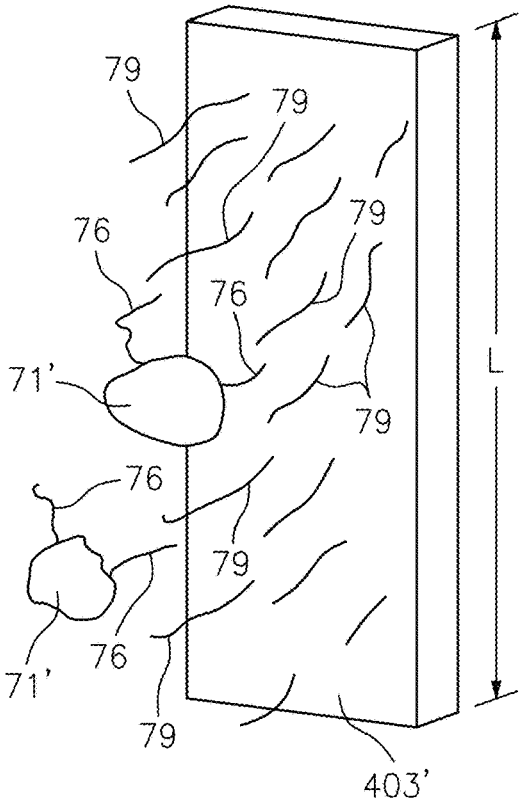
FIG. 9*c* illustrates a plurality of hydrophobic molecules attached to edges or surfaces for attracting non-mineral particles, according to some embodiments of the present invention.
Figure 9B:
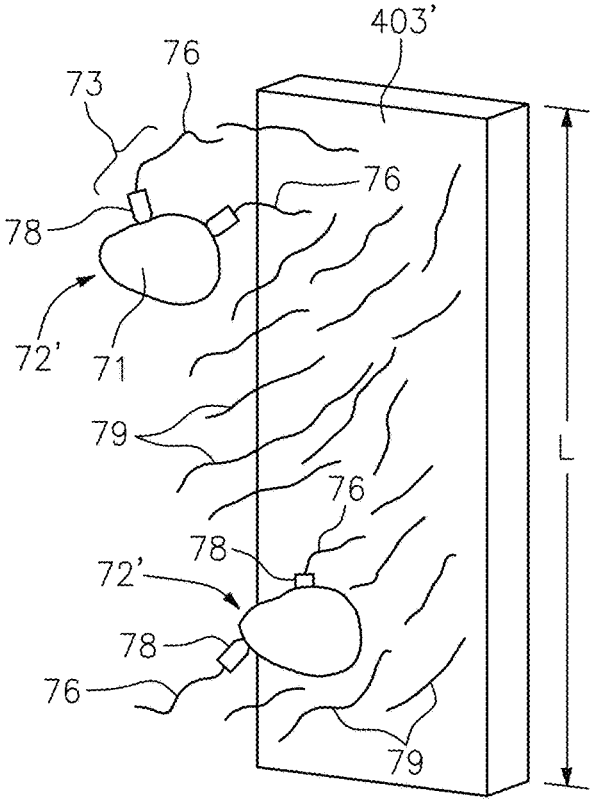
FIG. 9*b* illustrates a plurality of hydrophobic molecules attached to edges or surfaces for attracting mineral particles, according to some embodiments of the present invention.

The surfaces and edges around the openings or surface structures 701, 702, 703, 704 (FIGS. 7*a*-7*d*) can be functionalized to provide the molecules 73 (FIGS. 9*a*, 9*b*). The exposed surfaces and edges around the openings or surface structures 701, 702, 703, 704 are represented by surface portions 403, 403' as shown in FIGS. 9*a*-9*c*. The length L of the surface portions 403, 403' can be equal to the thickness of the conveyor belt 120, the filter 220 and the collection plate 320 (FIGS. 5*a*-5*c*). As with the fiber 401 as shown in FIG. 8*a*, the surface portion 403 can be made of a polymer that has a plurality of molecules 73 to provide the functional group 78 and the attaching molecular segment 76. In a different embodiment, the surface portion 403 may be coated with polymer that has the molecules 73 to provide the functional group 78 and the attaching molecular segment 76. The surface portion 403 can be made of glass, ceramic, metal, nylon, cotton or a different polymer. The functional group 78 may be used to attract mineral particles of interest 72. A diagram of the surface portion 403 and the attached molecules 73 is shown in FIG. 9*a*.

In a different embodiment of the present invention, the surface portion 403' can be made of a polymer having a plurality of molecules 79 that render the surface portion 403' (and thus the collection areas 123, 223 and 323 of FIGS. 5*a*-5*c*) hydrophobic. As with the hydrophobic fiber 401' as shown in FIGS. 8*b* and 8*c*, the polymer can be a hydrophobic material such as polystyrene, poly(d,l-lactide), poly (dimethylsiloxane), polypropylene, polyacrylic, polyethylene, etc. The polymer can also be a hydrophobically-modified polymer, such as hydrophobically-modified ethyl hydroxyethyl cellulose. Alternatively, the surface portion 403' can be made of glass, ceramic, metal, nylon, cotton or other fabric materials and coated with hydrophobic molecules, such as polysiloxanates, alkylsilane and fluoroalkylsilane. The molecules 79 cause the surface portion 403' to become hydrophobic. As such, a hydrophobically-modified mineral particle 72' is attracted to the hydrophobic surface portion 403'. A diagram showing the attraction between the molecular segments 76 and the hydrophobic surface portion 403' is shown in FIG. 9*b*. It should be understood that the particles 72' may be non-mineral and can be some harmful particles in a body of water. Furthermore, the hydrophobic surface portion 403' can also be used to attract non-mineral particles. For example, if a non-mineral particle 71' has one or more hydrophobic chains or molecular segments 76, the non-mineral particle 71' may also be attracted to the hydrophobic surface portion 403'. A diagram showing the attraction between the non-mineral particles 71' and the hydrophobic surface portion 403' is shown in FIG. 9*c*. Thus, a filter, collection plate or conveyor belt (similar to those shown in FIGS. 5*a*-5*c*) that has hydrophobic surface portions 403' can also be used for water-pollution control, water purification, etc. to rid of hydrophobically-modified particles 72' which may not be a mineral of interest, but some metal or other material or chemical harmful to the environment.

The treatment of plain surface 706 (FIG. 7*f*) can be made similar to the surface portions 403, 403' as shown in FIGS. 9*a*-9*c*. That is, the plain surface 706 can be functionalized to provide a functional group 78 as shown in FIG. 9*a*. The plain surface 706 can also be functionalized to be hydrophobic, as shown in FIGS. 9*b* and 9*c*.

It should be understood that, when the collection area or surface 123 of the conveyor belt 120 (FIG. 5*a*), the collection area or surface 223 of the filter 220 (FIG. 5*b*) and the collection area 323 of the collection plate 320 (FIG. 5*c*) are functionalized to be hydrophobic, the tailings 12 in the recovery processor 50 (FIGS. 2*b*-2*d*, 3*a*-3*c*) and the tailings in the pond 100 (FIGS. 2*a* and 2*d*) must be mixed with collector molecules such as xanthates so that the mineral particles 71 (FIGS. 8*b* and 9*b*) in the tailings may be hydrophobically modified with the collector molecules 73 to become wetted mineral particles 72'.

Figure 10A:
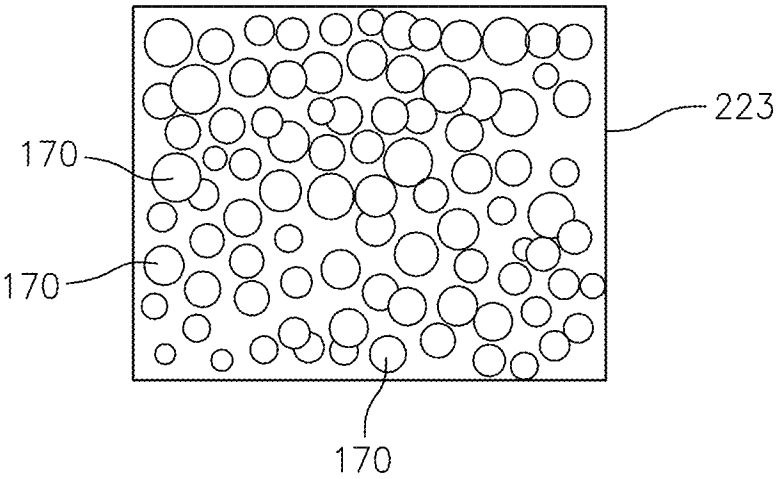
FIG. 10*a* illustrates a filter using a plurality of synthetic beads or bubbles for collecting valuable material in tailings of a flotation process, according to some embodiments of the present invention.
Figure 10B:
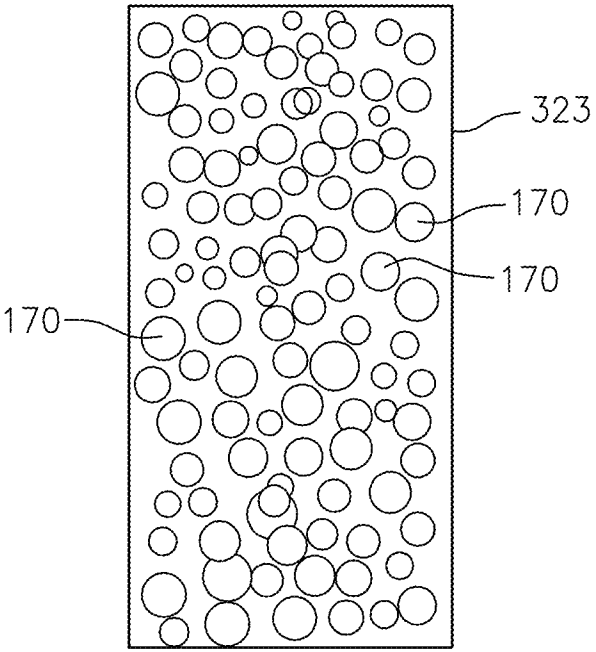
FIG. 10*b* illustrates a collection plate using a plurality of synthetic beads or bubbles for collecting valuable material in tailings of a flotation process, according to some embodiments of the present invention.
Figure 10C:
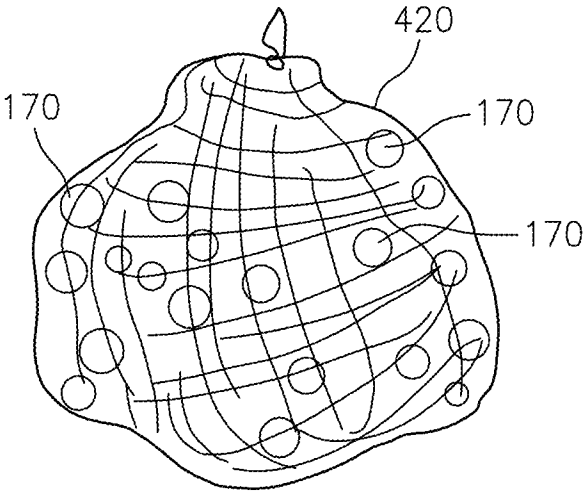
FIG. 10*c* illustrates a sack of synthetic beads which can be used as a filter to collect valuable material in tailings of a flotation process, according to some embodiments of the present invention.

FIGS. 10*a*-10*c*: Different Embodiments

In different embodiments of the present invention, the functionalized synthetic material can be used to provide those particular molecules on beads or bubbles, or to make the beads or bubbles (see FIGS. 11*a*-12*b*). The bubbles or beads that have the particular molecules having a functional group configured to attract mineral particles of interest are herein referred to as synthetic bubbles or beads. By way of example, the synthetic beads or bubbles 170 may be used in a filter 220 to collect mineral particles 72, 72' (see FIGS. 8*a*-9*b*, 11*a*-12*b*). As shown in FIG. 10*a*, the filter may use a cage or the like to contain a plurality of synthetic beads to provide the collection surfaces in the collection area 223. As shown in FIG. 10*b*, the collection plate uses a cage or the like to contain a plurality of synthetic beads 170 to provide the collection surfaces in the collection area 323. When the synthetic beads or bubbles 170 are used to collect valuable material in a tailings pond 100 (FIG. 13), they can be put in a sack 420 as shown in FIG. 10*c*. As with the synthetic material that is used on the collection surfaces 403, 403' (FIGS. 9*a*-9*c*), the synthetic material to be used on the synthetic beads or bubbles 170 may have the functional groups 78 to attract the mineral particles 72, or may have the hydrophobic molecules 79.

Figure 11B:
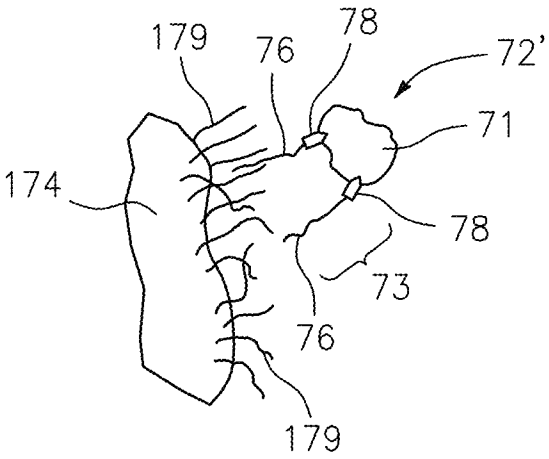
FIG. 11*b* is an enlarged surface portion of the synthetic bead functionalized to attract wetted mineral particles, according to some embodiments of the present invention.
Figure 11C:
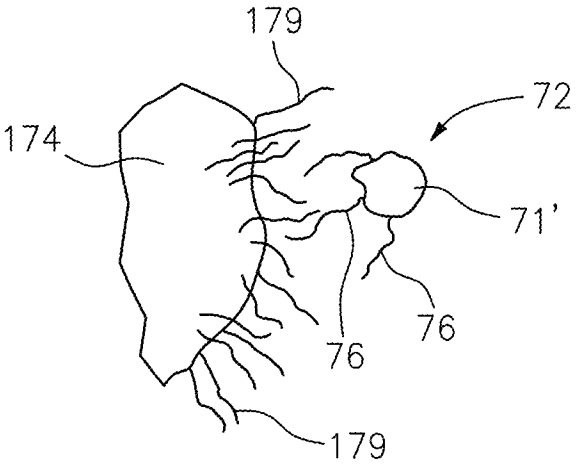
FIG. 11*c* is an enlarged surface portion of the synthetic bead functionalized to attract non-mineral hydrophobic particles, according to some embodiments of the present invention.
Figure 11A:
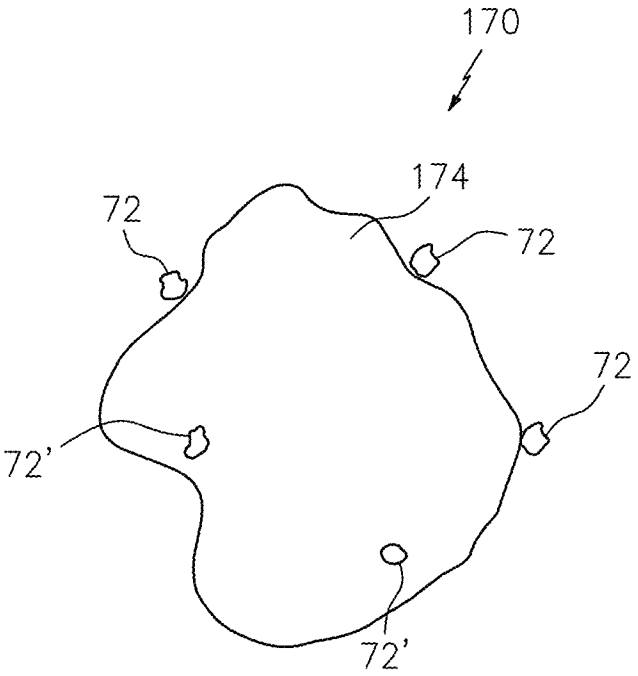
FIG. 11*a* illustrates a synthetic bead functionalized to attract hydrophobic particles, according to some embodiments of the present invention.

FIG. 11*a* illustrates a synthetic bead functionalized to attract hydrophobic particles. As shown in FIG. 11*a*, the synthetic bubble or bead 170 has a solid-phase bead body to provide a bead surface 174. At least the outside part of the bead body is made of a synthetic material, such as a hydrophobic polymer, or a coating of a hydrophobic chemical. As shown in FIGS. 11*a* and 11*b*, the surface 174 of the synthetic bubble or bead comprises a plurality of molecules 79 which renders the surface 174 hydrophobic. For example, the surface 174 may be a glass surface coated with polysiloxanates which can bind to the hydroxyl group of the glass surface. Polysiloxanates, such as hydroxyl-terminated polydimethysiloxanes, have a silicon-oxygen chain to provide the hydrophobic molecules 79. The hydrophobic particle 72', as shown in FIG. 11*b*, can be a mineral particle 71 having one or more collectors 73 attached thereto. One end (78) of the collector 73 has an ionizing bond attached to the mineral particle 71. The other end of the collector 73 has a hydrophobic chain 76 which tends to move into the hydrophobic molecules 79. Thus, the hydrophobic particle 72' can be a wetted mineral particle. A collector, such as xanthate, has both the functional group 78 and the molecule 76. The hydrophobic particle 72, as shown in FIG. 11*c*, can be a particle 71' that has a hydrophobic chain 76. Such particle can be non-mineral related, but it can be arranged to contact with the hydrophobic synthetic bubbles or beads 170 of the present inventions. Likewise, the particle 71 may be non-mineral and can be harmful to the environment. Thus the hydrophobic bubbles or beads 170, according to the present invention, can be used in non-mining applications, such as water-pollution control. The size of the synthetic bead can be smaller than the minimum size of the mineral particles which is about 150 μm, and can be larger than the maximum size of the mineral particles. In certain applications, the size of the synthetic bead can be 1 cm or larger.

Figure 12B:
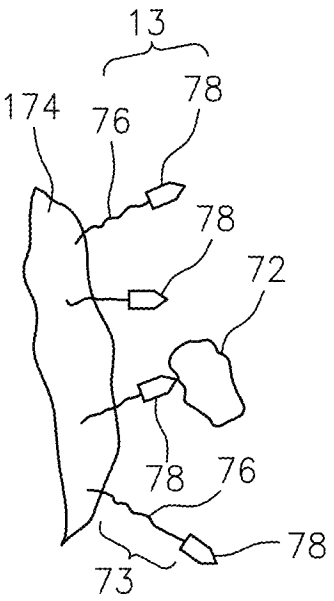
FIG. 12*b* is an enlarged surface portion of the synthetic bead functionalized to attract mineral particles, according to some embodiments of the present invention.
Figure 12A:
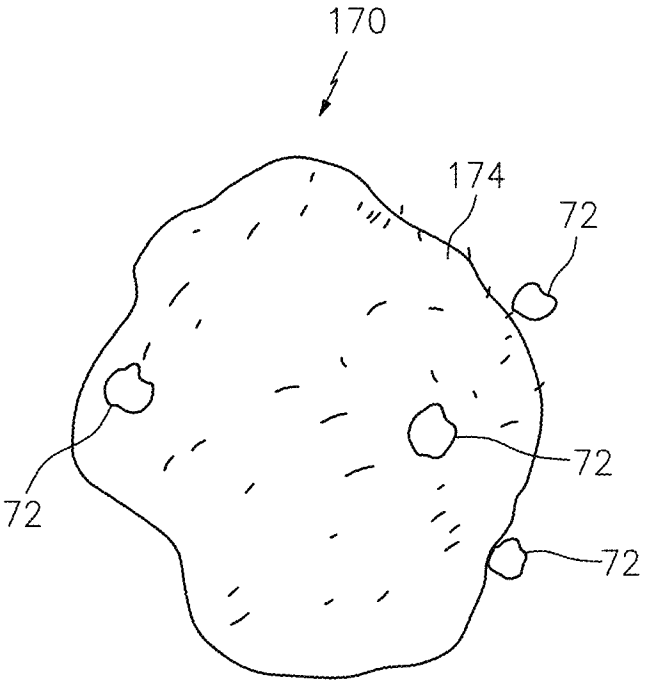
FIG. 12*a* illustrates a synthetic bead having a functional group to attract mineral particles, according to some embodiments of the present invention.

FIG. 12*a* illustrates a synthetic bead having a functional group to attract mineral particles of interest. The synthetic bead 170 has a bead body to provide a bead surface 174 to attract mineral particles of interest 72. FIG. 12*b* is an enlarged surface of the synthetic bead functionalized to attract mineral particles of interest. At least the outside part of the bead body may be made of a synthetic material, such as polymer, so as to provide a plurality of molecules or molecular segments 76 on the surface 174. The molecule 76 may be used to attach a chemical functional group 78 to the surface 174. In general, the molecule 76 can be a hydrocarbon chain, for example, and the functional group 78 can have an anionic bond for attracting a mineral, such as copper to the surface 174. A xanthate, for example, has both the functional group 78 and the molecular segment 76 to be incorporated into the polymer that is used to make the synthetic bead 70. The functional group 78 is also known as a collector that is either ionic or non-ionic for bonding to the mineral particles 72. Similarly, a chelating agent can be incorporated into or onto the polymer as a collector site for attracting a mineral, such as copper.

The releasing of the mineral particles from the synthetic beads can be similar to the releasing of the mineral particles from the collection plate, conveyor belt or the filter. For example, after the synthetic beads 170 in the collection area 223 or 323 or in the sack 320 (FIGS. 10*a*-10*c*) have collected a certain amount of mineral particles, the synthetic beads 170 can be made contact with a low pH solution and/or subjected to ultrasonic agitation (e.g., FIG. 4) in order to release the mineral particles.

Figure 13:
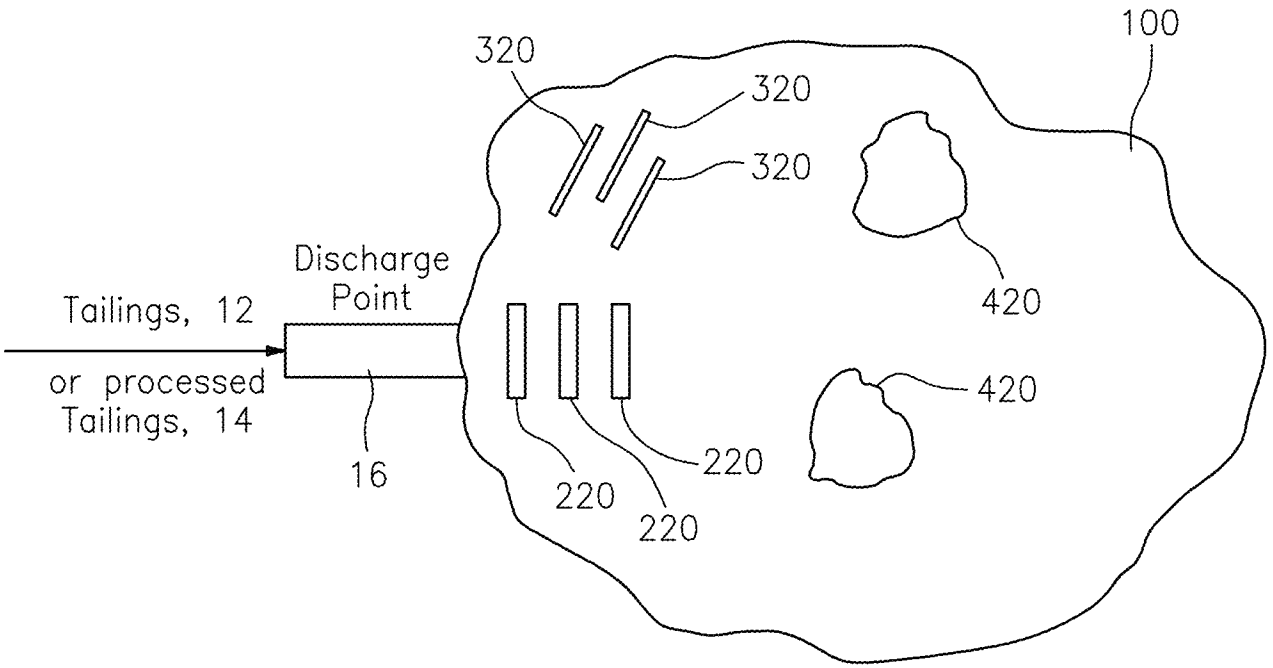
FIG. 13 illustrates a tailings pond wherein a plurality of functionalized polymer coated surfaces configured to attract the valuable material in the pond, according to some embodiments of the present invention.

FIG. 13 illustrates a tailings pond wherein a plurality of functionalized polymer coated surfaces may be configured to attract the valuable material of interest in the pond. As shown in FIG. 13, tailings 12 (FIG. 2*a*) or processed tailings (FIGS. 2*b*-3*c*) may be discharged into the tailings pond 100 at a discharge point 16. A plurality of filters 220 can be placed near the discharge point 16 to collect the valuable material of interest in the tailings 12 or processed tailings 14 in the pond. It is also possible to place a plurality of collection plates 320 and a plurality of sacks 420 in the pond to collect the valuable material therein. The filters 220, the collection plates 320 and the sacks 420 may be moved around in order to increase the contact between the valuable material and the functionalized polymer provided in the filters 220, collection plates 320 and sacks 420.

Figure 14B:
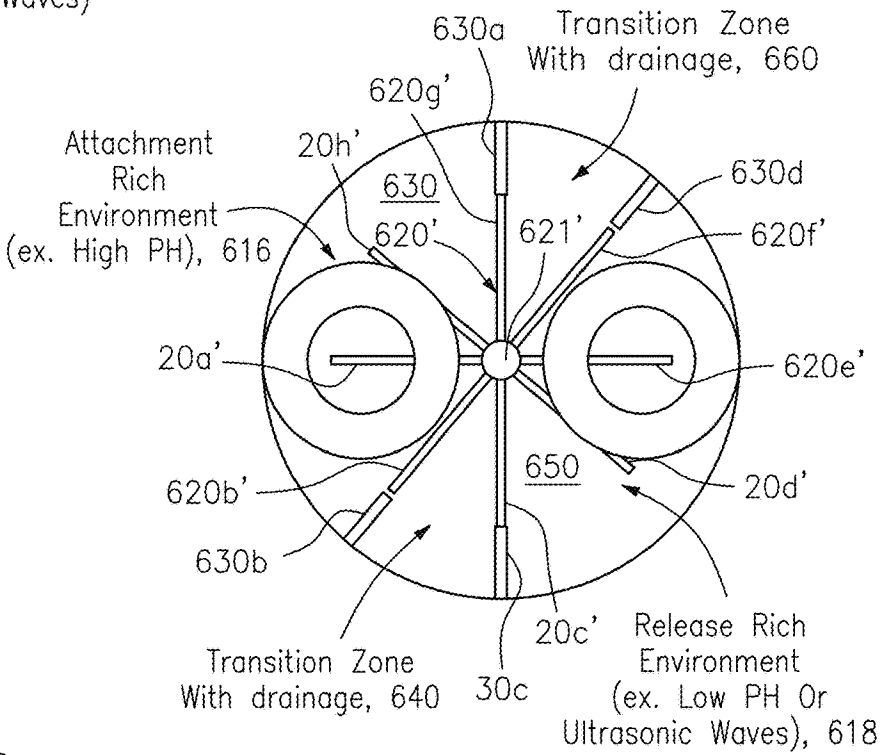
FIG. 14*b* is a top partial cross-sectional view in diagram form of a functionalized polymer coated impeller moving in an attachment rich environment contained in an attachment chamber, tank or column and also moving in a release rich environment contained in a release chamber, tank or column according to some embodiments of the present invention.
Figure 14A:
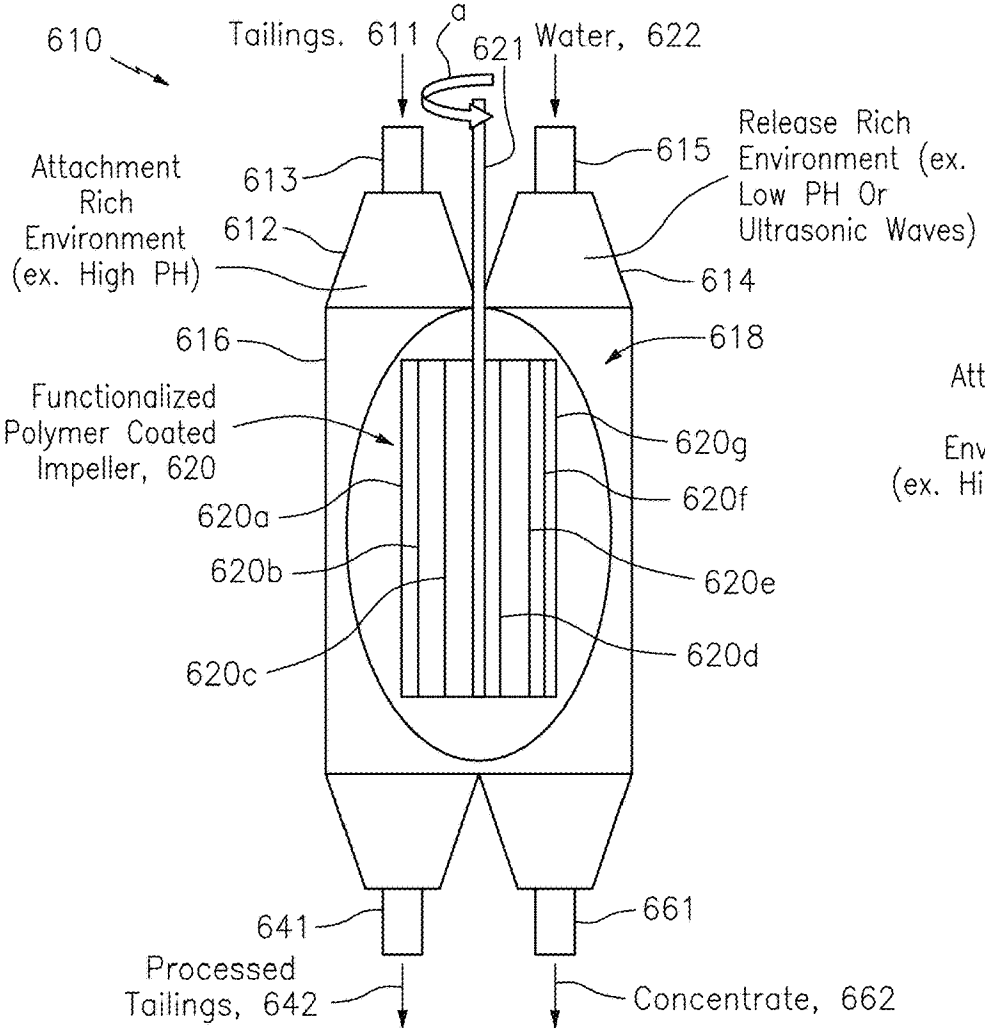
FIG. 14*a* is a side partial cutaway view in diagram form of a separation processor configured with two chambers, tanks or columns having a functionalized polymer coated impeller arranged therein according to some embodiments of the present invention, and includes

FIGS. 14, 14*a*, 14*b*

By way of example, FIG. 14 shows the present invention is the form of a machine, device, system or apparatus 610, e.g., for separating valuable material from unwanted material in a mixture 611, such as tailings, using a first processor 612 and a second processor 614. The first processor 612 and the second processor 614 may be configured with a functionalized polymer coated member that is shown, e.g., as a functionalized polymer coated impeller 620 (FIG. 14*a*), 620' (FIG. 14*b*), according to some embodiments of the present invention. In operation, the impeller 620, 620' slowly rotates in relation to the first processor 612 and the second processor 614, the impeller blades slowly pass through the attachment rich environment 616 in the first processor 612 where the valuable material is attached to the blades and through the release rich environment 618 in the second processor 614. is released from the blades. By way of example, the impeller 620 is shown rotating in a counterclockwise direction as indicated by arrow a, although the scope of the invention is not intended to be limited to the direction of the impeller rotation, or the manner in which the functionalized polymer coated impeller 620 (FIG. 14*a*), 620' (FIG. 14*b*) is arranged, mounted, or configured in relation to the first processor 612 and the second processor 614.

The first processor 612 may take the form of a first chamber, tank, cell or column that contains an attachment rich environment generally indicated as 616. The first chamber, tank or column 612 may be configured to receive via piping 613 the mixture or tailings 611 in the form of fluid (e.g., water), the valuable material and the unwanted material in the attachment rich environment 616, e.g., which has a high pH, conducive to attachment of the valuable material. The second processor 614 may take the form of a second chamber, tank, cell or column that contains a release rich environment generally indicated as 618. The second chamber, tank, cell or column 614 may be configured to receive via piping 615, e.g., water 622 in the release rich environment 618, e.g., which may have a low pH or receive ultrasonic waves conducive to release of the valuable material. Attachment rich environments like that forming part of element environment 616 conducive to the attachment of a valuable material of interest and release rich environments like that forming part of environment 618 conducive to the release of the valuable material of interest are known in the art, and the scope of the invention is not intended to be limited to any particular type or kind thereof either now known or later developed in the future. Moreover, a person skilled in the art would be able to formulate an attachment rich environment like environment 616 and a corresponding release rich environment like environment 618 based on the separation technology disclosed herein for any particular valuable mineral of interest, e.g., copper, forming part of any particular mixture or tailings.

In operation, the first processor 612 may be configured to receive the mixture or tailings 611 of water, valuable material and unwanted material and the functionalized polymer coated member that is configured to attach to the valuable material in the attachment rich environment 616. In FIG. 14, the functionalized polymer coated member is shown as the functionalized polymer coated impeller 620 (FIG. 14*a*), 620' (FIG. 14*b*). In FIG. 14*a*, the functionalized polymer coated impeller 620 has a shaft 621 and at least one impeller blade 620*a*, 620*b*, 620*c*, 620*d*, 620*e*, 620*f*, 620*g* and is configured to rotate slowly inside the first processor 612 and the second processor 614. In FIG. 14*b*, the functionalized polymer coated impeller 620' has a shaft 621' and impeller blades 620*a*', 620*b*', 620*c*', 620*d*', 620*e*', 620*f*', 620*g*' and 620*h*'. Each impeller blade in FIG. 14 is understood to be configured and functionalized with a polymer coating to attach to the valuable material in the attachment rich environment 616. (The scope of the invention is not intended to be limited to the number of blades on the impeller 620, 620' and the embodiment in FIGS. 14*a* and 14*b* is shown with impellers 621, 621' having a different number of blades.)

In FIG. 14, the first processor 612 is configured to receive at least one impeller blade of the functionalized polymer coated impeller 620 (FIG. 14*a*), 620' (FIG. 14*b*). In FIG. 1*b*, the at least one impeller blade is shown as impeller blade 620*g*' being received in an attachment zone 630 that forms part of the attachment rich environment 616 defined by walls 30*a*, 30*b*. The first processor 612 may also be configured with a first transition zone generally indicated as 640 to provide drainage from piping 641 of, e.g., processed tailings 642 as shown in FIG. 14*a*.

The first processor 612 may also be configured to provide at least one enriched impeller blade having the valuable material attached thereto, after passing through the attachment rich environment 616. In FIG. 14*b*, the at least one enriched impeller blade is shown as the at least one enriched impeller blade 620*c*' being provisioned from the attachment rich environment 616 in the first processor 612 to the release rich environment 618 in the second processor 614.

The second processor 614 may be configured to receive via the piping 615 the fluid 622 (e.g. water) and the enriched functionalized polymer coated member to release the valuable material in the release rich environment 618. In FIG. 14*b*, the second processor 614 is shown receiving the enriched impeller blade 620*c*' in a release zone 650, e.g., that forms part of the release rich environment 618 and is defined, e.g., by walls 630*c* and 630*d*.

The second processor 614 may also be configured to provide the valuable material that is released from the enriched functionalized polymer coated member into the release rich environment 618. For example, in FIG. 14*b* the second processor 614 is shown configured with a second transition zone 660 defined by walls 630*a* and 630*d* to provide via piping 661 drainage of the valuable material in the form of a concentrate 662 (FIG. 14*a*).

Figure 15:
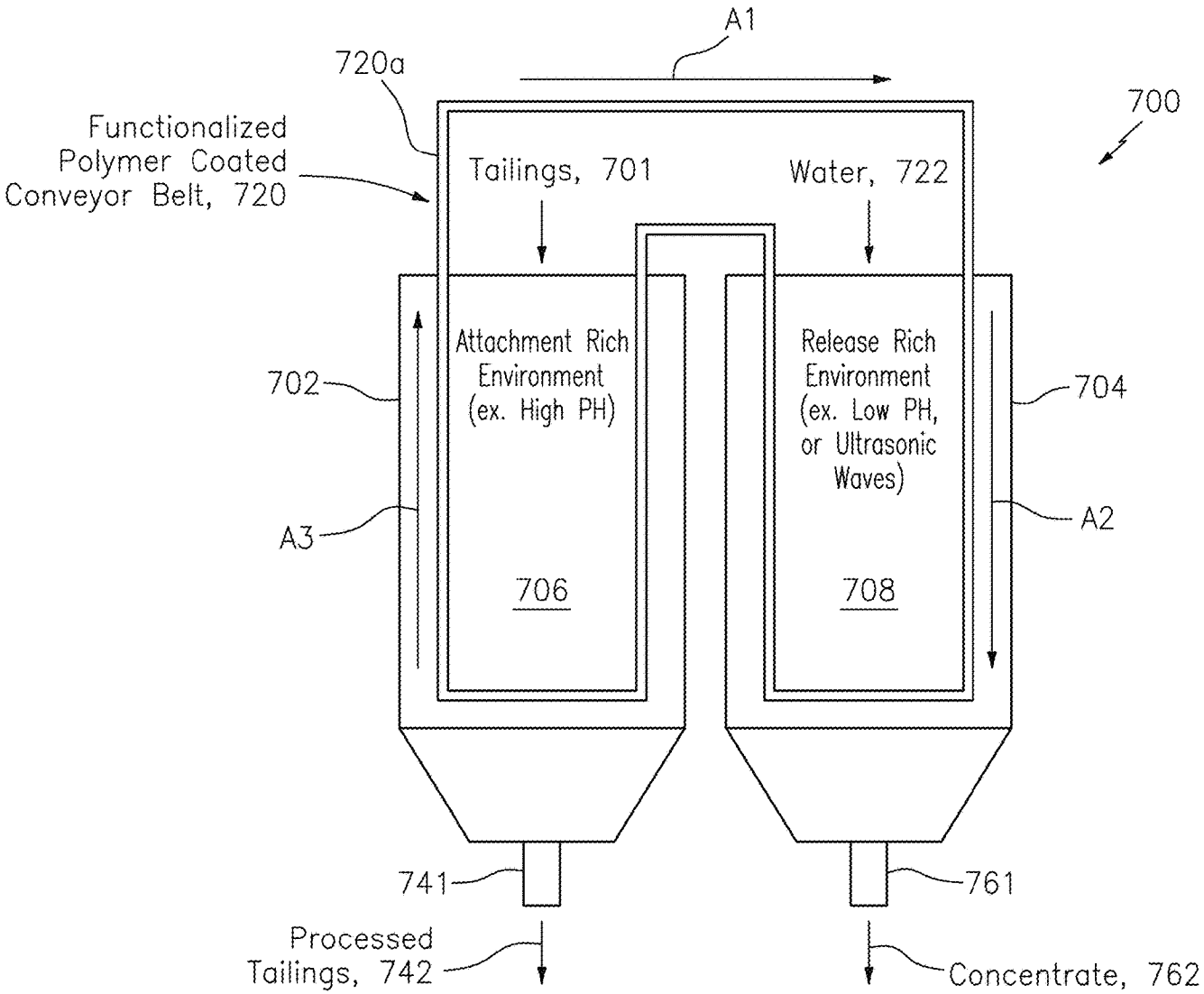
FIG. 15 is diagram of a separation processor configured with two chambers, tanks or columns having a functionalized polymer coated conveyor belt arranged therein, according to some embodiments of the present invention.

FIG. 15: The Functionalized Polymer Coated Conveyor Belt

By way of example, FIG. 15 shows the present invention is the form of a machine, device, system or apparatus 700, e.g., for separating valuable material from unwanted material in a mixture 701, such as a tailings, using a first processor 702 and a second processor 704. The first processor 702 and the second processor 704 are configured with a functionalized polymer coated member that is shown, e.g., as a functionalized polymer coated conveyor belt 720 that runs between the first processor 702 and the second processor 704, according to some embodiments of the present invention. The arrows A1, A2, A3 indicate the movement of the functionalized polymer coated conveyor belt 720. Techniques, including motors, gearing, etc., for running a conveyor belt like element 720 between two processors like elements 702 and 704 are known in the art, and the scope of the invention is not intended to be limited to any particular type or kind thereof either now know or later developed in the future. According to some embodiments of the present invention, the functionalized polymer coated conveyor belt 720 may be made of a mesh material.

The first processor 702 may take the form of a first chamber, tank, cell or column that contains an attachment rich environment generally indicated as 706. The first chamber, tank or column 702 may be configured to receive the mixture or tailings 701 in the form of fluid (e.g., water), the valuable material and the unwanted material in the attachment rich environment 706, e.g., which has a high pH, conducive to attachment of the valuable material. The second processor 704 may take the form of a second chamber, tank, cell or column that contains a release rich environment generally indicated as 708. The second chamber, tank, cell or column 704 may be configured to receive, e.g., water 722 in the release rich environment 708, e.g., which may have a low pH or receive ultrasonic waves conducive to release of the valuable material. Consistent with that stated above, attachment rich environments like that forming part of element environment 706 conducive to the attachment of a valuable material of interest and release rich environments like that forming part of environment 708 conducive to the release of the valuable material of interest are known in the art, and the scope of the invention is not intended to be limited to any particular type or kind thereof either now known or later developed in the future. Moreover, a person skilled in the art would be able to formulate an attachment rich environment like environment 106 and a corresponding release rich environment like environment 708 based on the separation technology disclosed herein for any particular valuable mineral of interest, e.g., copper, forming part of any particular mixture or tailings.

In operation, the first processor 702 may be configured to receive the mixture or tailings 701 of water, valuable material and unwanted material and the functionalized polymer coated conveyor belt 720 that is configured to attach to the valuable material in the attachment rich environment 706. In FIG. 15, the belt 720 is understood to be configured and functionalized with a polymer coating to attach to the valuable material in the attachment rich environment 706.

The first processor 702 may also be configured to provide drainage from piping 741 of, e.g., processed tailings 742 as shown in FIG. 15.

The first processor 702 may also be configured to provide an enriched functionalized polymer coated conveyor belt having the valuable material attached thereto, after passing through the attachment rich environment 706. In FIG. 15, the enriched functionalized polymer coated conveyor belt is shown, e.g., as that portion or part 720*a* of the belt 720 being provisioned from the attachment rich environment 106 in the first processor 702 to the release rich environment 708 in the second processor 704. It is understood that some other portions or parts of the belt 720 may be enriched, including the portion or part immediately leaving the attachment rich environment 706, as well as the portion or part immediately entering the release rich environment 708.

The second processor 704 may be configured to receive the fluid 722 (e.g. water) and the portion 720*a* of the enriched functionalized polymer coated conveyor belt 720 to release the valuable material in the release rich environment 708.

The second processor 704 may also be configured to provide the valuable material that is released from the enriched functionalized polymer coated member into the release rich environment 708. For example, in FIG. 15 the second processor 704 is shown configured to provide via piping 761 drainage of the valuable material in the form of a concentrate 762.

In FIG. 15, the first processor 702 is configured with the functionalized polymer coated conveyor belt 720 passing through with only two turns inside the attachment rich environment 706. However, embodiments are envisioned in which the first processor 702 may be configured to process the functionalized polymer coated conveyor belt 720 using a serpentine technique for winding or turning the belt 720 one way and another way, back and forth, inside the first processor to maximize surface area of the belt inside the processor 702 and exposure of the belt 720 to the attachment rich environment 706.

Figure 16:
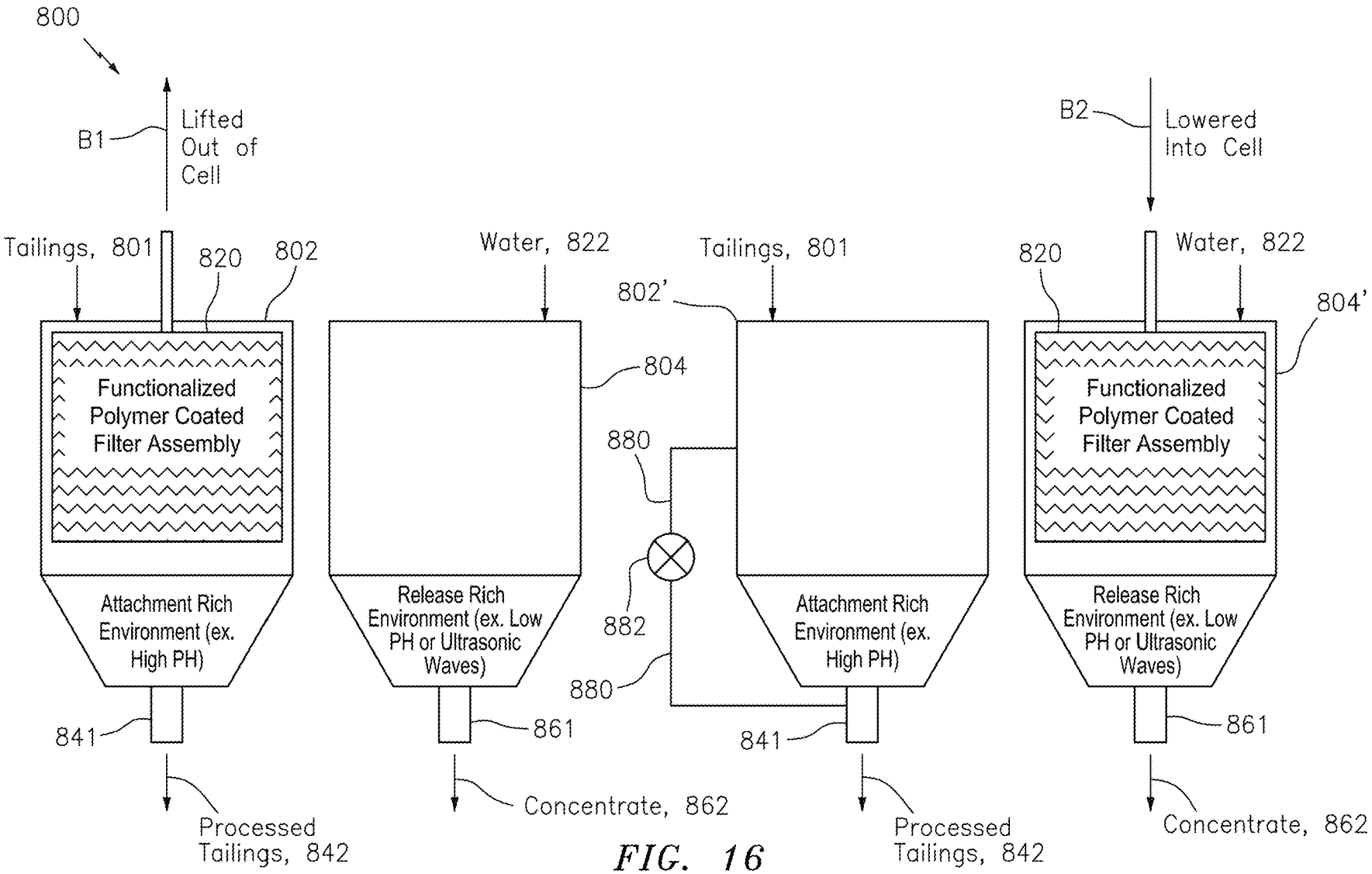
FIG. 16 is diagram of a separation processor configured with a functionalized polymer coated filter assembly for moving between two chambers, tanks or columns in a semi-continuous batch process, according to some embodiments of the present invention.

FIG. 16: The Functionalized Polymer Coated Filter

By way of example, FIG. 16 shows the present invention is the form of a machine, device, system or apparatus 800, e.g., for separating valuable material from unwanted material in a mixture 801, such as tailings, using a first processor 802, 802' and a second processor 804, 804'. The first processor 802 and the second processor 804 are configured to process a functionalized polymer coated member that is shown, e.g., as a functionalized polymer coated collection filter 820 configured to be moved between the first processor 802 and the second processor 804' as shown in FIG. 16 as part of a batch type process, according to some embodiments of the present invention. In FIG. 16, by way of example the batch type process is shown as having two first processor 802, 802' and second processor 804, 804, although the scope of the invention is not intended to be limited to the number of first or second processors. Moreover, embodiments are envisioned using a different number of first and second processor, different types or kinds of processors, as well as different types or kinds of processors both now known or later developed in the future. According to some embodiments of the present invention, the functionalized polymer coated collection filter 820 may take the form of a membrane or a thin soft pliable sheet or layer. The arrow B1 indicates the movement of the functionalized polymer coated filter 820 from the first processor 202, and the arrow B2 indicates the movement of the functionalized polymer coated collection filter 820 into the second processor 802. Techniques, including motors, gearing, etc., for moving a filter like element 820 from one processor to another processor like elements 802 and 804 are known in the art, and the scope of the invention is not intended to be limited to any particular type or kind thereof either now know or later developed in the future.

The first processor 802 may take the form of a first chamber, tank, cell or column that contains an attachment rich environment generally indicated as 806. The first chamber, tank or column 802 may be configured to receive the mixture or tailings 801 in the form of fluid (e.g., water), the valuable material and the unwanted material in the attachment rich environment 806, e.g., which has a high pH, conducive to attachment of the valuable material. The second processor 804 may take the form of a second chamber, tank, cell or column that contains a release rich environment generally indicated as 808. The second chamber, tank, cell or column 804 may be configured to receive, e.g., water 822 in the release rich environment 808, e.g., which may have a low pH or receive ultrasonic waves conducive to release of the valuable material. Consistent with that stated above, attachment rich environments like that forming part of element environment 806 conducive to the attachment of a valuable material of interest and release rich environments like that forming part of environment 808 conducive to the release of the valuable material of interest are known in the art, and the scope of the invention is not intended to be limited to any particular type or kind thereof either now known or later developed in the future. Moreover, a person skilled in the art would be able to formulate an attachment rich environment like environment 806 and a corresponding release rich environment like environment 808 based on the separation technology disclosed herein for any particular valuable mineral of interest, e.g., copper, forming part of any particular mixture or tailings.

In operation, the first processor 802 may be configured to receive the mixture or tailings 101 of water, valuable material and unwanted material and the functionalized polymer coated collection filter 820 that is configured to attach to the valuable material in the attachment rich environment 806. In FIG. 16, the functionalized polymer coated collection filter 620 is understood to be configured and functionalized with a polymer coating to attach to the valuable material in the attachment rich environment.

The first processor 802 may also be configured to provide drainage from piping 841 of, e.g., processed tailings 842 as shown in FIG. 16.

The first processor 802 may also be configured to provide an enriched functionalized polymer coated collection filter having the valuable material attached thereto, after soaking in the attachment rich environment. In FIG. 16, the enriched functionalized polymer coated collection filter 820 is shown, e.g., being provisioned from the attachment rich environment 806 in the first processor 202 to the release rich environment 808 in the second processor 204.

The second processor 804 may be configured to receive the fluid 822 (e.g. water) and the enriched functionalized polymer coated collection filter 820 to release the valuable material in the release rich environment 808.

The second processor 804 may also be configured to provide the valuable material that is released from the enriched functionalized polymer coated collection filter 220 into the release rich environment 808. For example, in FIG. 16 the second processor 804 is shown configured to provide via piping 861 drainage of the valuable material in the form of a concentrate 862.

The first processor 802' may also be configured with piping 880 and pumping 880 to recirculate the tailings 842 back into the first processor 802'. The scope of the invention is also intended to include the second processor 804' being configured with corresponding piping and pumping to recirculate the concentrate 862 back into the second processor 804'. Similar recirculation techniques may be implemented for the embodiments disclosed in relation to FIGS. 14-15 above.

The scope of the invention is not intended to be limited to the type or kind of batch process being implemented. For example, embodiments are envisioned in which the batch process may include the first and second processors 802, 804 being configured to process the enriched functionalized polymer coated collection filter 820 in relation to one type or kind of valuable material, and the first and second processors 802',804' being configured to process the enriched functionalized polymer coated collection filter 820 in relation to either the same type or kind of valuable material, or a different type or kind of valuable material. Moreover, the scope of the invention is intended to include batch processes both now known and later developed in the future.

Polymer Surface Having Functional Groups

The term "polymer" in this disclosure means a large molecule made of many units of the same or similar structure linked together. In some embodiments of the present invention, the polymer surface on a filter has a plurality of molecules 73 (FIGS. 8*a*, 9*a*) having a functional group 78 (FIGS. 8*a*, 8*b*) to attract mineral particles 72 (FIGS. 8*a*, 9*a*). In these embodiments, the unit can be a monomer or an oligomer which forms the basis of, for example, polyamides (nylon), polyesters, polyurethanes, phenol-formaldehyde, urea-formaldehyde, melamine-formaldehyde, polyacetal, polyethylene, polyisobutylene, polyacrylonitrile, poly(vinyl chloride), polystyrene, poly(methyl methacrylates), poly(vinyl acetate), poly(vinylidene chloride), polyisoprene, polybutadiene, polyacrylates, poly(carbonate), phenolic resin, polydimethylsiloxane and other organic or inorganic polymers. Thus, the synthetic material can be hard or rigid like plastic or soft and flexible like an elastomer. While the physical properties of the synthetic beads can vary, the surface of the synthetic beads is chemically functionalized to provide a plurality of functional groups to attract mineral particles. The terms "valuable material" and "mineral particle" are used herein interchangeably. It is possible to use a molecule or molecular segment 76 (FIG. 8*a*, 9*a*) to attach a function group 78 to the polymer surface. In general, the molecule 76 can be a hydrocarbon chain, for example, and the functional group 78 can be an ion or charge species for bonding to a mineral, such as copper to the surface 74. A xanthate, for example, has both the functional group 78 and the molecular segment 76 to be incorporated into the polymer that is used to make the synthetic bead 70. A functional group 78 is also known as a collector that is either ionic or non-ionic. The ion can be anionic or cationic. An anion includes, but not limited to, oxyhydryl, such as carboxylic, sulfates and sulfonates, and sulfhydral, such as xanthates and dithiophosphates. Other molecules or compounds that can be used to provide the function group 78 include thionocarboamates, thioureas, xanthogens, monothiophosphates, hydroquinones and polyamines. Similarly, a chelating agent can be incorporated into the polymer as a collector site for attracting a mineral, such as copper. A surface having a functionalized polymer is also referred herein as synthetic surface.

Polymer Having Molecules to Render a Surface Hydrophobic

In some embodiments of the present invention, at least the surface of a filter surface is functionalized so that the surface is hydrophobic. It is possible to functionalize a polymer surface to have a plurality of molecules 79 (FIGS. 8*b*, 8*c*, 9*b*, 9*c*) to render the surface hydrophobic. A hydrophobic surface tends to attract hydrophobic molecules.

In chemistry, hydrophobicity is the physical property of a molecule (known as a hydrophobe) that is repelled from a mass of water. Hydrophobic molecules tend to be non-polar and, thus, prefer other neutral molecules and non-polar solvents. Hydrophobic molecules in water often cluster together. According to thermodynamics, matter seeks to be in a low-energy state, and bonding reduces chemical energy. Water is electrically polarized, and is able to form hydrogen bonds internally, which gives it many of its unique physical properties. But, since hydrophobes are not electrically polarized, and because they are unable to form hydrogen bonds, water repels hydrophobes, in favor of bonding with itself. It is this effect that causes the hydrophobic interaction.

The hydrophobic effect is the observed tendency of non-polar substances to aggregate in aqueous solution and exclude water molecules. It can be observed as the segregation and apparent repulsion between water and non-polar substances. The hydrophobic interaction is mostly an entropic effect originating from the disruption of highly dynamic hydrogen bonds between molecules of liquid water by the non-polar solute. A hydrocarbon chain or a similar non-polar region or a big molecule is incapable of forming hydrogen bonds with water. The introduction of such a non-hydrogen bonding surface into water causes disruption of the hydrogen bonding network between water molecules. The hydrogen bonds are reoriented tangential to such a surface to minimize disruption of the hydrogen bonded 3D network of water molecules and thus leads to a structured water "cage" around the nonpolar surface. The water molecules that form the "cage" (or solvation shell) have restricted mobilities. For example, in the case of larger non-polar molecules the reorientational and translational motion of the water molecules in the solvation shell may be restricted by a factor of two to four. Generally, this leads to significant losses in translational and rotational entropy of water molecules and makes the process unfavorable in terms of free energy of the system. By aggregating together, nonpolar molecules reduce the surface area exposed to water and minimize their disruptive effect.

The desired mineral is rendered hydrophobic by the addition of a surfactant or collector chemical. To be effective on tailings, the collectors are chosen based upon their selective wetting of the types of particles to be separated. A good collector will adsorb, physically or chemically, with one of the types of particles.

Collectors

Collectors either chemically bond (chemisorption) on a hydrophobic mineral surface, or adsorb onto the surface in the case of, for example, coal flotation through physisorption. Collectors increase the hydrophobicity of the surface, increasing the separability of the hydrophobic and hydrophilic particles. The hydrophobic particles of interest, according to the present invention, are depicted as particles 71',72' in FIGS. 8*b*, 8*c*, 9*b* and 9*c*.

Figure 17B:
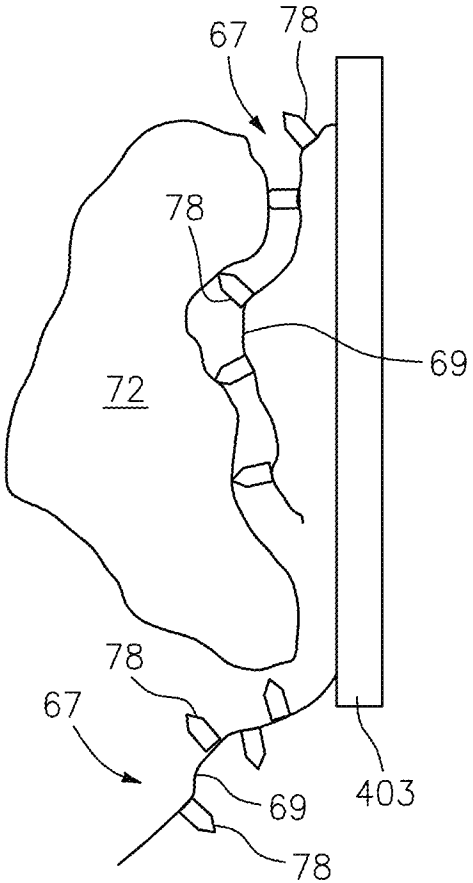
FIG. 17*b* shows a large mineral particle is attracted to a plurality of functional groups provided on a backbone of a molecule, according to some embodiments of the present invention.
Figure 17A:
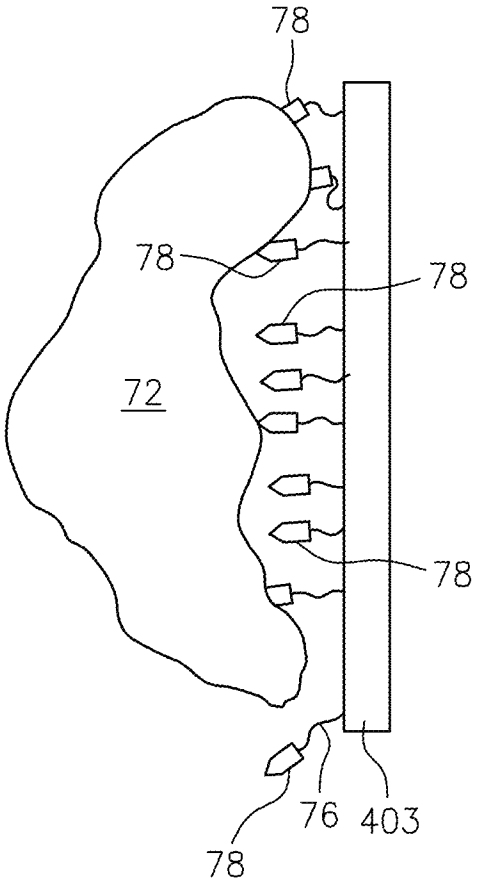
FIG. 17*a* shows a large mineral particle is attracted to a plurality of functional groups provided on a surface of a filter, according to some embodiments of the present invention.
Figure 17C:
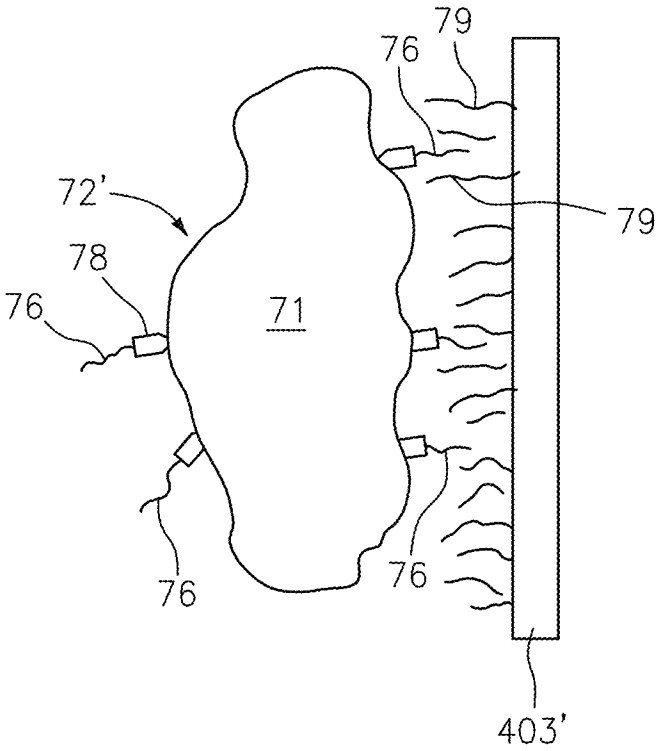
FIG. 17*c* shows a large, wetted mineral particle is attracted to a plurality of hydrophobic molecules on a surface of a filter, according to some embodiments of the present invention.

FIGS. 17*a*-17*c*: Large Mineral Particles

It should be noted that the mineral particles in the tailings can be relatively large as compared to the mineral particles recovered in the flotation process. Some mineral particles may be larger than 200μm, for example. It is likely that a large mineral particle requires more bonding forces so that it can be attached to a functionalized surface. As shown in FIG. 17*a*, the mineral particle 72 is attached to the filter surface 403 by the attraction of many function groups 78. In order to increase the bonding forces between the filter surface 403 and the mineral particle 72, it is possible to functionalize the surface 403 with molecules 67 comprising a plurality of functional groups 78 attached to a flexible backbone or chain 69. As such, many more functional groups 78 can be drawn to the surface of the mineral particle 72, as shown in FIG. 17*b*. FIG. 17*c* shows a large wetted mineral particle 72' is attracted or attached to the filter surface 403 which is render hydrophobic by molecules 79.

Figure 18B:
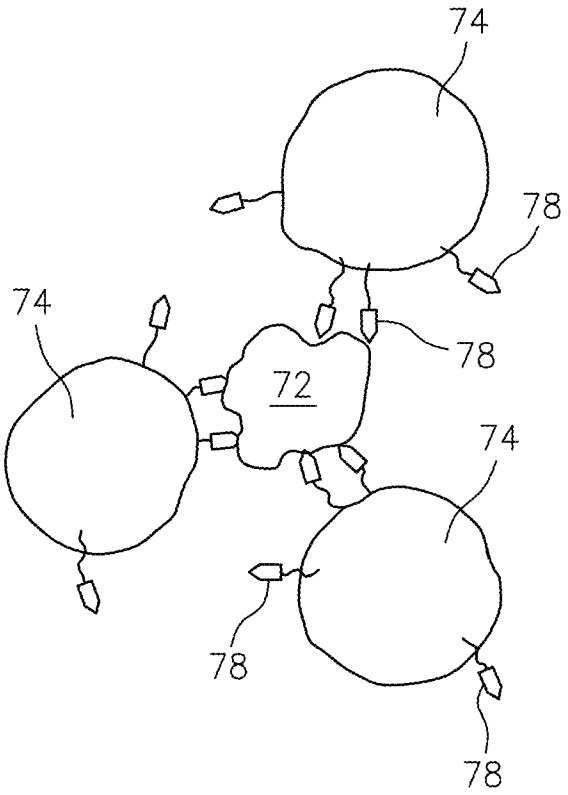
FIG. 18*b* illustrates a mineral particle being attached to a number of slightly larger synthetic beads at the same time, according to some embodiments of the present invention.
Figure 18A:
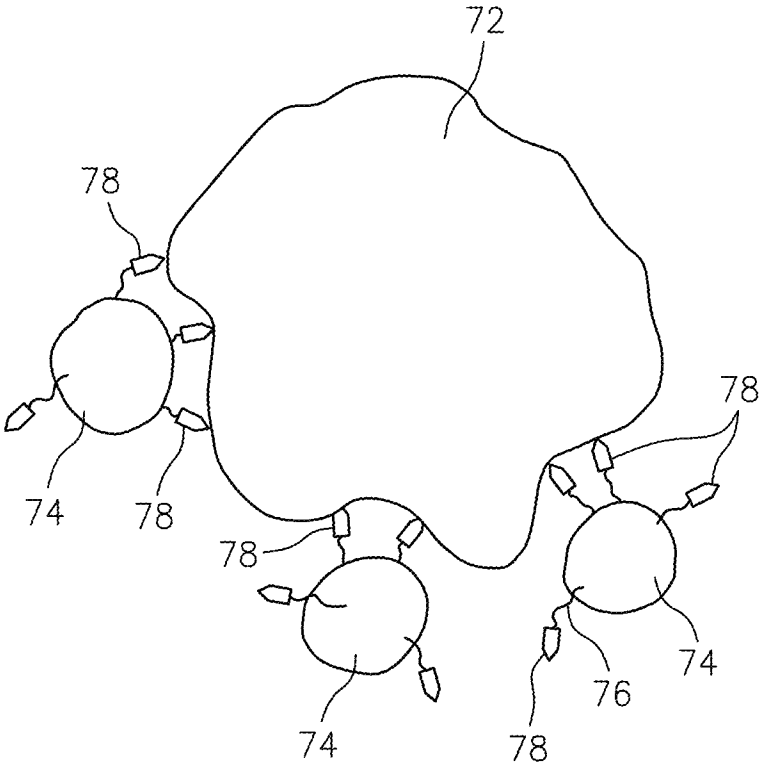
FIG. 18*a* illustrates a mineral particle being attached to a number of much smaller synthetic beads at the same time, according to some embodiments of the present invention.

FIG. 18*a* illustrates a scenario where a mineral particle 72 is attached to a number of synthetic beads 74 at the same time. Thus, although the synthetic beads 74 are much smaller in size than the mineral particle 72, a number of synthetic beads 74 may be able to lift the mineral particle 72 upward in a flotation cell. Likewise, a smaller mineral particle 72 can also be lifted upward by a number of synthetic beads 74 as shown in FIG. 18*b*. In order to increase the likelihood for this "cooperative" lifting to occur, a large number of synthetic beads 74 can be mixed into the slurry. Unlike air bubbles, the density of the synthetic beads can be chosen such that the synthetic beads may stay along in the slurry before they rise to surface in a flotation cell.

Figure 19B:
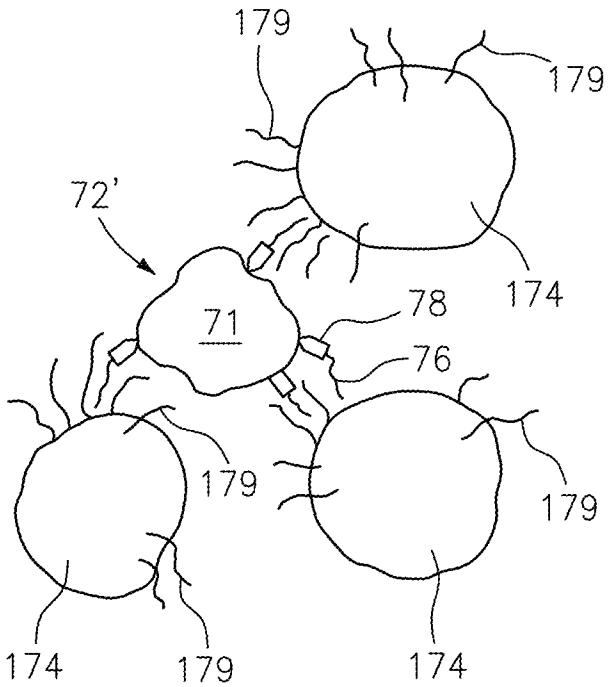
FIG. 19*b* illustrates a wetted mineral particle being attached to a number of slightly larger hydrophobic synthetic beads at the same time, according to some embodiments of the present invention.
Figure 19A:
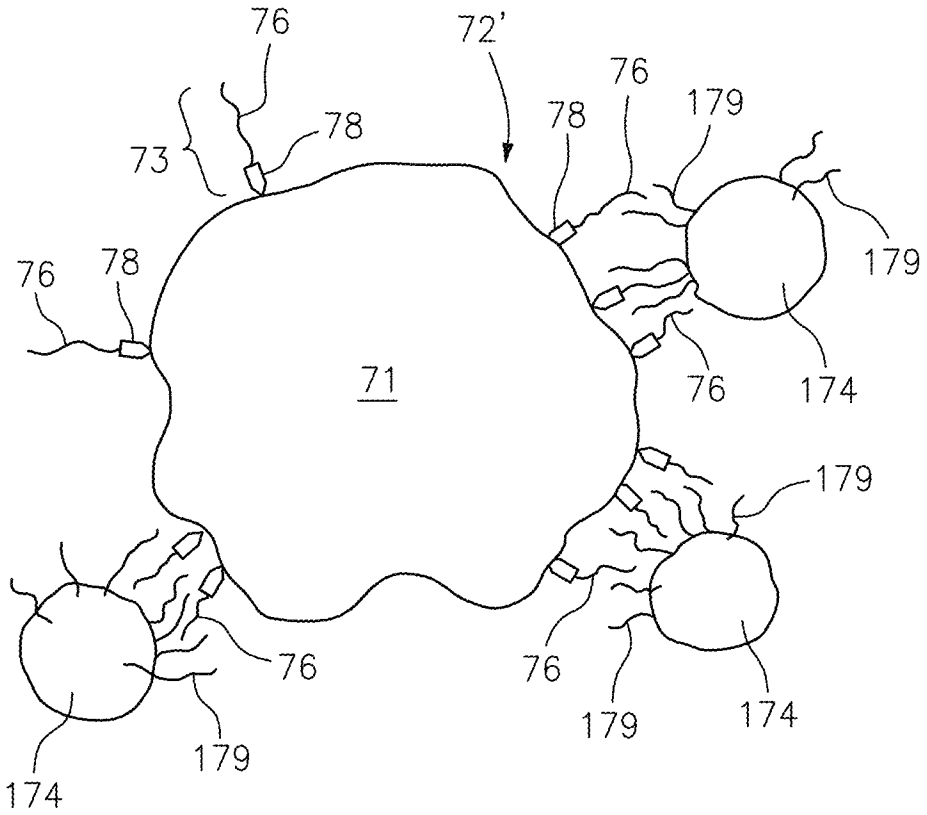
FIG. 19*a* illustrates a wetted mineral particle being attached to a number of much smaller hydrophobic synthetic beads at the same time, according to some embodiments of the present invention.

FIGS. 19*a* and 19*b* illustrate a similar scenario. As shown, a wetted mineral particle 172 is attached to a number of hydrophobic synthetic beads 174 at the same time.

Applications

The scope of the invention is described in relation to mineral separation, including the separation of copper from ore.

By way of example, applications are envisioned to include rougher, scavenger, cleaner and Rougher/scavenger separation cells in the production stream, replacing the traditional flotation machines.

Tailings scavenger cells are used to scavenge the unrecovered minerals from a tailings stream.

Tailings cleaning cell is used to clean unwanted material from the tailings stream before it is sent to the disposal pond.

Tailings reclamation machine that is placed in the tailings pond to recover valuable mineral that has been sent to the tailings pond.

It should be understood that the synthetic beads according to the present invention, whether functionalized to have a collector or functionalized to be hydrophobic, are also configured for use in oilsands separation—to separate bitumen from sand and water in the recovery of bitumen in an oilsands mining operation. Likewise, the functionalized filters and membranes, according to some embodiments of the present invention, are also configured for oilsands separation.

According to some embodiments of the present invention, the surface of a synthetic bead can be functionalized to have a collector molecule. The collector has a functional group with an ion capable of forming a chemical bond with a mineral particle. A mineral particle associated with one or more collector molecules is referred to as a wetted mineral particle. According to some embodiments of the present invention, the synthetic bead can be functionalized to be hydrophobic in order to collect one or more wetted mineral particles.

Other types or kinds of valuable material or minerals of interest, include gold, molybdenum, etc.

However, the scope of the invention is intended to include other types or kinds of applications either now known or later developed in the future.

FIGS. 20*a* Thru 20*d*

According to a different embodiment of the present invention, the synthetic bead can be a porous block or take the form of a sponge or foam with multiple segregated gas filled chambers. This application expands upon and develops out in further detail various inventions related to the use of engineered collection media in the form of foam, Styrofoam, etc. in relation to FIGS. 20*a* through 20*d*, which are described as follows By way of example, the synthetic bead can be a porous block or take the form of a sponge or foam with multiple segregated gas filled chamber. According to some embodiments of the present invention, the foam or sponge can take the form of a filter, a membrane or a conveyor belt as described in PCT application no. PCT/US12/39534, entitled "Mineral separation using functionalized membranes;" filed 21 May 2012, which is hereby incorporated by reference in its entirety. Therefore, the synthetic beads described herein are generalized as engineered collection media. Likewise, a porous material, foam or sponge may be generalized as a material with three-dimensional open-cellular structure, an open-cell foam or reticulated foam, which can be made from soft polymers, hard plastics, ceramics, carbon fibers, glass and/or metals, and may include a hydrophobic chemical having molecules to attract and attach mineral particles to the surfaces of the engineered collection media.

Open-cell foam or reticulated foam offers an advantage over non-open cell materials by having higher surface area to volume ratio. Applying a functionalized polymer coating that promotes attachment of mineral to the foam "network" enables higher mineral recovery rates and also improves recovery of less liberated mineral than conventional process. For example, the open cells in an engineered foam block allow passage of fluid and particles smaller than the cell size but captures mineral particles that come in contact with the functionalized polymer coating on the open cells. This also allows the selection of cell size dependent upon slurry properties and application.

Figures 20A, 20B, 20C, 20D:
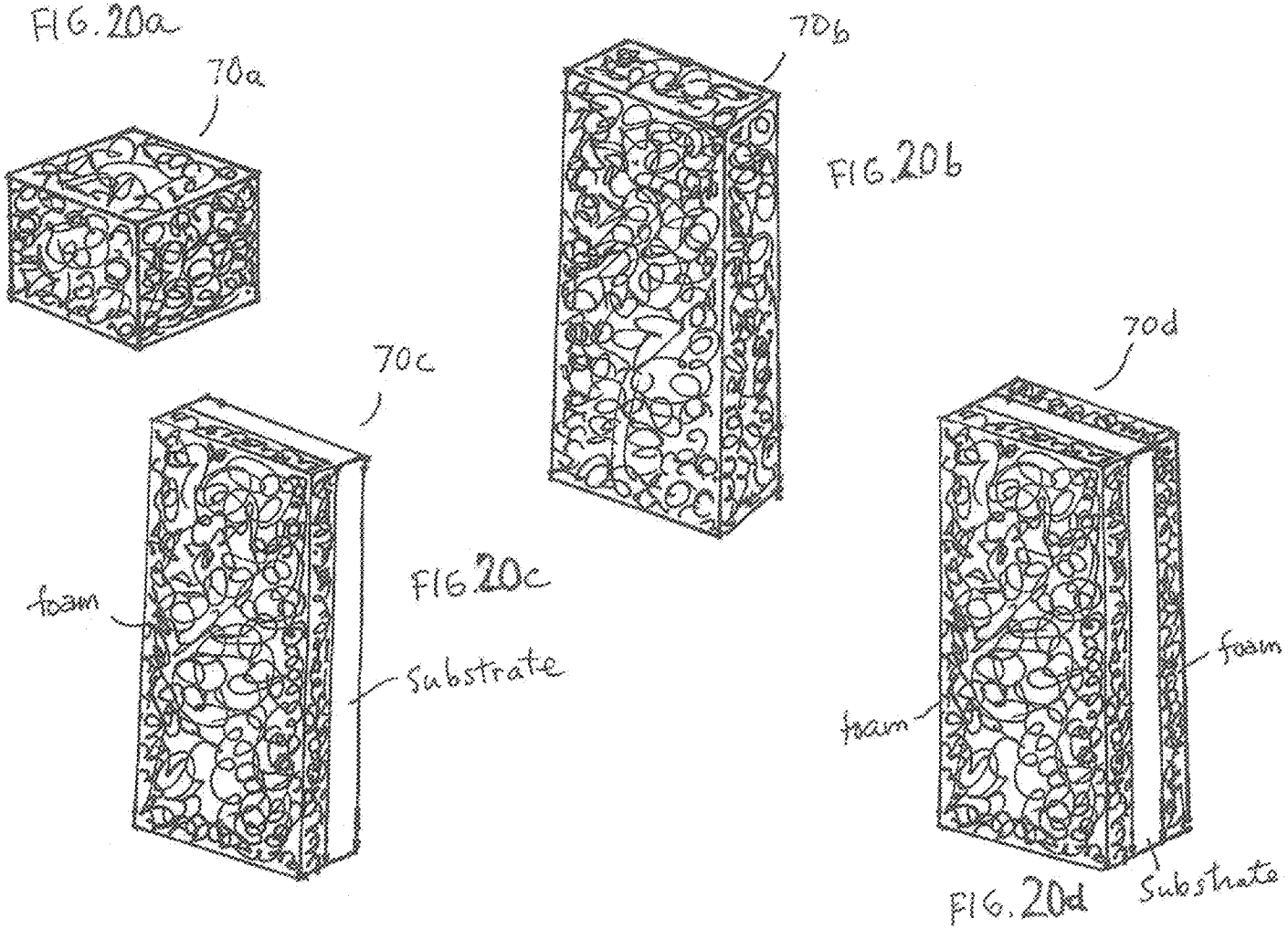
FIG. 20*a* illustrates a collection media taking the form of an open-cell foam in a cubic shape.
FIG. 20*b* illustrates a filter according to some embodiments of the present invention.
FIG. 20*c* illustrates a section of a membrane or conveyor belt according to an embodiment of the present invention.
FIG. 20*d* illustrates a section of a membrane or conveyor belt according to another embodiment of the present invention.
Figure 21:
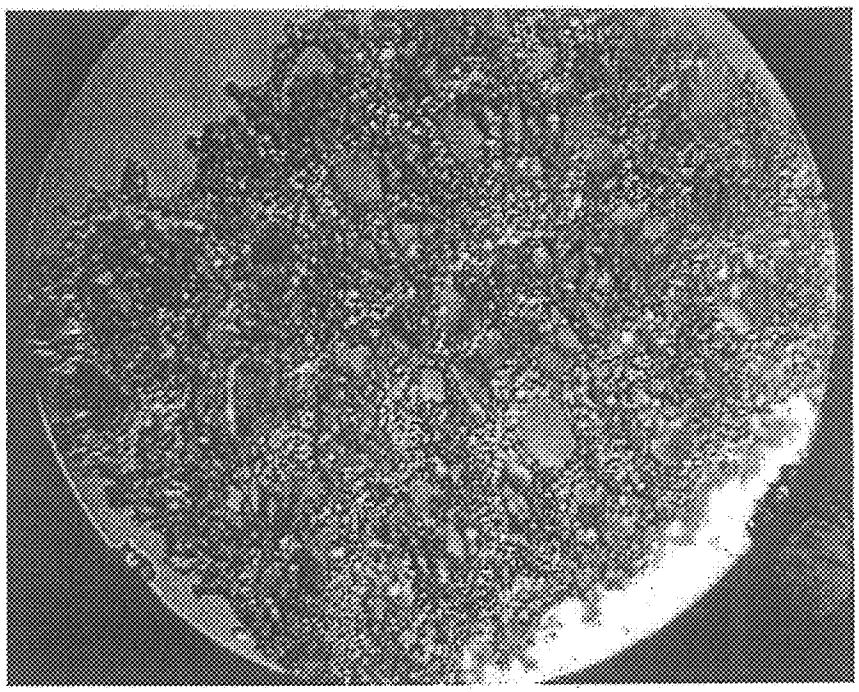
FIG. 21 is a picture showing reticulated foam with Cu Mineral entrained throughout the structure.

According to some embodiments of the present invention, the engineered collection media take the form of an open-cell foam/structure in a rectangular block or a cubic shape 70*a* as illustrated in FIG. 20*a*. Dependent upon the material that is used to make the collection media, the specific gravity of the collection media can be smaller than, equal to or greater than the slurry. Thus, when the collection media are mixed with the slurry for mineral recovery, it is advantageous to use the tumbler cells, e.g., that are disclosed in PCT application serial no. PCT/US16US/68843, entitled "Tumbler cell form mineral recovery using engineered media," filed 28 Dec. 2016, which claims benefit to Provisional Application No. 62/272,026, filed 28 Dec. 2015, which are both incorporated by reference herein in their entirety.

According to some embodiments of the present invention, the engineered collection media may take the form of a filter 70*b* with a three-dimensional open-cell structure as shown in FIG. 20*b*. The filter 70*b* can be used in a filtering assembly as disclosed herein.

According some embodiments of the present invention, the engineered collection media may take the form of a membrane 70*c*, a section of which is shown in FIG. 20*c*. As seen in FIG. 20*c*, the membrane 70*c* can have an open-cell foam layer attached to a substrate or base. The substrate can be made from a material which is less porous than the open-cell foam layer. For example, the substrate can be a sheet of pliable polymer to enhance the durability of the membrane. The membrane 70*c* can be used as a conveyor belt as disclosed herein.

According some embodiments of the present invention, the engineered collection media may take the form of a membrane 70*d*, a section of which is shown in FIG. 20*d*. As seen in FIG. 20*d*, the membrane 70*d* can have two open-cell foam layers attached to two sides of a substrate or base. The substrate can made of a material which is less porous than the open-cell foam layer. The membrane 70*d* can also be used as a conveyor belt as disclosed herein.

In various embodiments of the present invention, the engineered collection media as shown in FIGS. 20*a*-20*d* may include, or take the form of, a solid-phase body configured with a three-dimensional open-cell structure to provide a plurality of collection surfaces; and a coating may be configured to provide on the collection surfaces a plurality of molecules comprising a functional group having a chemical bond for attracting one or more mineral particles in an aqueous mixture to the molecules, causing the mineral particles to attached to the collection surfaces.

In some embodiments of the present invention, the open-cell structure or foam may include a coating attached thereto to provide a plurality of molecules to attract mineral particles, the coating including a hydrophobic chemical selected from a group consisting of polysiloxanates, poly (dimethylsiloxane) and fluoroalkylsilane, or what are commonly known as pressure sensitive adhesives with low surface energy.

In some embodiments of the present invention, the solid phase body may be made from a material selected from polyurethane, polyester urethane, polyether urethane, reinforced urethanes, PVC coated PV, silicone, polychloroprene, polyisocyanurate, polystyrene, polyolefin, polyvinylchloride, epoxy, latex, fluoropolymer, polypropylene, phenolic, EPDM, and nitrile.

In some embodiments of the present invention, the solid phase body may including a coating or layer, e.g., that may be modified with tackifiers, plasticizers, crosslinking agents, chain transfer agents, chain extenders, adhesion promoters, aryl or alky copolymers, fluorinated copolymers, hexamethyldisilazane, silica or hydrophobic silica.

In some embodiments of the present invention, the solid phase body may include a coating or layer, e.g., made of a material selected from acrylics, butyl rubber, ethylene vinyl acetate, natural rubber, nitriles; styrene block copolymers with ethylene, propylene, and isoprene; polyurethanes, and polyvinyl ethers.

In some embodiments of the present invention, an adhesion agent may be provided between the solid phase body and the coating so as to promote adhesion between the solid phase body and the coating.

In some embodiments of the present invention, the solid phase body may be made of plastic, ceramic, carbon fiber or metal.

In some embodiments of the present invention, the three-dimensional open-cell structure may include pores ranging from 10-200 pores per inch.

In some embodiments of the present inventions, the engineered collection media may be encased in a cage structure that allows a mineral-containing slurry to pass through the cage structure so as to facilitate the contact between the mineral particles in slurry and the engineered collection media.

In some embodiments of the present invention, the cage structures or the filters carrying mineral particles may be removed from the processor so that they can be stripped of the mineral particles, cleaned and reused.

Three Dimensional Functionalized Open-Network Structure

Surface area is an important property in the mineral recovery process because it defines the amount of mass that can be captured and recovered. High surface area to volume ratios allows higher recovery per unit volume of media added to a cell. As illustrated in FIGS. 20*a* to 20*d*, the engineered collection media are shown as having an open-cell structure. Open cell or reticulated foam offers an advantage over other media shapes such as the sphere by having higher surface area to volume ratio. Applying a functionalized polymer coating that promotes attachment of mineral to the foam "network" enables higher recovery rates and improved recovery of less liberated mineral when compared to the conventional process. For example, open cells allow passage of fluid and unattracted particles smaller than the cell size but capture mineral bearing particles that come in contact with the functionalized polymer coating. Selection of cell size is dependent upon slurry properties and application.

The coated foam may be cut in a variety of shapes and forms. For example, a polymer coated foam belt can be moved through the slurry to collect the desired minerals and then cleaned to remove the collected desired minerals. The cleaned foam belt can be reintroduced into the slurry. Strips, blocks, and/or sheets of coated foam of varying size can also be used where they are randomly mixed along with the slurry in a mixing cell. The thickness and cell size of a foam can be dimensioned to be used as a cartridge-like filter which can be removed, cleaned of recovered mineral, and reused.

As mentioned earlier, the open cell or reticulated foam, when coated or soaked with hydrophobic chemical, offers an advantage over other media shapes such as sphere by having higher surface area to volume ratio. Surface area is an important property in the mineral recovery process because it defines the amount of mass that can be captured and recovered. High surface area to volume ratios allows higher recovery per unit volume of media added to a cell.

The open cell or reticulated foam provides functionalized three dimensional open network structures having high surface area with extensive interior surfaces and tortuous paths protected from abrasion and premature release of attached mineral particles. This provides for enhanced collection and increased functional durability. Spherical shaped recovery media, such as beads, and also of belts, and filters, is poor surface area to volume ratio—these media do not provide high surface area for maximum collection of mineral. Furthermore, certain media such as beads, belts and filters may be subject to rapid degradation of functionality.

Applying a functionalized polymer coating that promotes attachment of mineral to the foam "network" enables higher recovery rates and improved recovery of less liberated mineral when compared to the conventional process. This foam is open cell so it allows passage of fluid and unattracted particles smaller than the cell size but captures mineral bearing particles the come in contact with the functionalized polymer coating. Selection of cell size is dependent upon slurry properties and application.

A three-dimensional open cellular structure optimized to provide a compliant, tacky surface of low energy enhances collection of hydrophobic or hydrophobized mineral particles ranging widely in particle size. This structure may include, or take the form of, open-cell foam coated with a compliant, tacky polymer of low surface energy. The foam may include, or take the form of, reticulated polyurethane or another appropriate open-cell foam material such as silicone, polychloroprene, polyisocyanurate, polystyrene, polyolefin, polyvinylchloride, epoxy, latex, fluoropolymer, phenolic, EPDM, nitrile, composite foams and such. The coating may be a polysiloxane derivative such as polydimethylsiloxane and may be modified with tackifiers, plasticizers, crosslinking agents, chain transfer agents, chain extenders, adhesion promoters, aryl or alky copolymers, fluorinated copolymers, hydrophobizing agents such as hexamethyldisilazane, and/or inorganic particles such as silica or hydrophobic silica. Alternatively, the coating may include, or take the form of, materials typically known as pressure sensitive adhesives, e.g. acrylics, butyl rubber, ethylene vinyl acetate, natural rubber, nitriles; styrene block copolymers with ethylene, propylene, and isoprene; polyurethanes, and polyvinyl ethers as long as they are formulated to be compliant and tacky with low surface energy.

The three-dimensional open cellular structure may be coated with a primer or other adhesion agent to promote adhesion of the outer collection coating to the underlying structure.

In addition to soft polymeric foams, other three-dimensional open cellular structures such as hard plastics, ceramics, carbon fiber, and metals may be used. Examples include Incofoam®, Duocel®, metal and ceramic foams produced by American Elements®, and porous hard plastics such as polypropylene honeycombs and such. These structures must be similarly optimized to provide a compliant, tacky surface of low energy by coating as above.

The three-dimensional, open cellular structures above may be coated or may be directly reacted to form a compliant, tacky surface of low energy.

The three-dimensional, open cellular structure may itself form a compliant, tacky surface of low energy by, for example, forming such a structure directly from the coating polymers as described above. This is accomplished through methods of forming open-cell polymeric foams known to the art.

The structure may be in the form of sheets, cubes, spheres, or other shapes as well as densities (described by pores per inch and pore size distribution), and levels of tortuosity that optimize surface access, surface area, mineral attachment/detachment kinetics, and durability. These structures may be additionally optimized to target certain mineral particle size ranges, with denser structures acquiring smaller particle sizes. In general, cellular densities may range from 10-200 pores per inch, more preferably 30-90 pores per inch, and most preferably 30-60 pores per inch.

The specific shape or form of the structure may be selected for optimum performance for a specific application. For example, the structure (coated foam for example) may be cut in a variety of shapes and forms. For example, a polymer coated foam belt could be moved through the slurry removing the desired mineral whereby it is cleaned and reintroduced into the slurry. Strips, blocks, and/or sheets of coated foam of varying size could also be used where they are randomly mixed along with the slurry in a mixing cell. Alternatively, a conveyor structure may be formed where the foam is encased in a cage structure that allows a mineral-containing slurry to pass through the cage structure to be introduced to the underlying foam structure where the mineral can react with the foam and thereafter be further processed in accordance with the present invention. The thickness and cell size could be changed to a form cartridge like filter whereby the filter is removed, cleaned of recovered mineral, and reused. FIG. 22 is an example a section of polymer coated reticulated foam that was used to recovery Chalcopyrite mineral. Mineral particles captured from copper ore slurry can be seen throughout the foam network.

There are numerous characteristics of the foam that may be important and should also be considered, as follows:

Mechanical durability: Ideally, the foam will be durable in the mineral separation process. For example, a life of over 30,000 cycles in a plant system would be beneficial. As discussed above, there are numerous foam structures that can provide the desired durability, including polyester urethanes, polyether urethanes, reinforced urethanes, more durable shapes (spheres & cylinders), composites like PVC coated PU, and non-urethanes. Other potential mechanically durable foam candidate includes metal, ceramic, and carbon fiber foams and hard, porous plastics.

Chemical durability: The mineral separation process can involve a high pH environment (up to 12.5), aqueous, and abrasive. Urethanes are subject to hydrolytic degradation, especially at pH extremes. While the functionalized polymer coating provides protection for the underlying foam, ideally, the foam carrier system is resistant to the chemical environment in the event that it is exposed.

Adhesion to the coating: If the foam surface energy is too low, adhesion of the functionalized polymer coating to the foam will be very difficult and it could abrade off. However, as discussed above, a low surface energy foam may be primed with a high energy primer prior to application of the functionalized polymer coating to improve adhesion of the coating to the foam carrier. Alternatively, the surface of the foam carrier may be chemically abraded to provide "grip points" on the surface for retention of the polymer coating, or a higher surface energy foam material may be utilized. Also, the functionalized polymer coating may be modified to improve its adherence to a lower surface energy foam. Alternatively, the functionalized polymer coating could be made to covalently bond to the foam.

Surface area: Higher surface area provides more sites for the mineral to bond to the functionalized polymer coating carried by the foam substrate. There is a tradeoff between larger surface area (for example using small pore cell foam) and ability of the coated foam structure to capture mineral while allowing gangue material to pass through and not be capture, for example due to a small cell size that would effectively entrap gangue material. The foam size is selected to optimize capture of the desired mineral and minimize mechanical entrainment of undesired gangue material.

Cell size distribution: Cell diameter needs to be large enough to allow gangue and mineral to be removed but small enough to provide high surface area. There should be an optimal cell diameter distribution for the capture and removal of specific mineral particle sizes.

Tortuosity: Cells that are perfectly straight cylinders have very low tortuosity. Cells that twist and turn throughout the foam have "tortuous paths" and yield foam of high tortuosity. The degree of tortuosity may be selected to optimize the potential interaction of a mineral particle with a coated section of the foam substrate, while not be too tortuous that undesirable gangue material in entrapped by the foam substrate.

Functionalized foam: It may be possible to covalently bond functional chemical groups to the foam surface. This could include covalently bonding the functionalized polymer coating to the foam or bonding small molecules to functional groups on the surface of the foam, thereby making the mineral-adhering functionality more durable.

The pore size (pores per inch (PPI)) of the foam is an important characteristic which can be leveraged to improved mineral recovery and/or target a specific size range of mineral. As the PPI increases the specific surface area (SSA) of the foam also increases. A high SSA presented to the process increases the probability of particle contact which results in a decrease in required residence time. This in turn, can lead to smaller size reactors. At the same time, higher PPI foam acts as a filter due to the smaller pore size and allows only particles smaller than the pores to enter into its core. This enables the ability to target, for example, mineral fines over coarse particles or opens the possibility of blending a combination of different PPI foam to optimize recovery performance across a specific size distribution.

The Scope of the Invention

It should be further appreciated that any of the features, characteristics, alternatives or modifications described regarding a particular embodiment herein may also be applied, used, or incorporated with any other embodiment described herein. In addition, it is contemplated that, while the embodiments described herein are useful for homogeneous flows, the embodiments described herein can also be used for dispersive flows having dispersive properties (e.g., stratified flow). Although the invention has been described and illustrated with respect to exemplary embodiments thereof, the foregoing and various other additions and omissions may be made therein and thereto without departing from the spirit and scope of the present invention.

What is claimed is:

1. A system having a collection processor configured to receive tailings of a flotation process, the tailings having mineral particles of interest; and at least one collection apparatus located in the collection processor, the collection apparatus having a collection surface configured with a functionalized polymer comprising a plurality of molecules having a functional group configured to attract the mineral particles of interest to the collection surface, the flotation process having one or more scavenger circuits configured to provide one or more scavenger circuit feeds having scavenger tails, wherein the system comprises one or more enhanced scavenger circuits having the at least one collection apparatus located in the collection processor and being configured to receive the one or more scavenger circuit feeds and provide enhanced scavenger circuit feeds having a first enhanced scavenger circuit feed with enhanced scavenger tails and a second enhanced scavenger circuit feed with enhanced scavenger concentrate for further processing by the system, based upon the at least one collection apparatus located in the collection processor, wherein the one or more scavenger circuits includes a cleaner scavenger circuit configured to provide a cleaner scavenger circuit feed; and the one or more enhanced scavenger circuits comprises an enhanced scavenger circuit configured to receive the cleaner scavenger circuit feed and provide the first enhanced scavenger circuit feed and the second enhanced scavenger circuit feed for further processing by the system, and wherein the flotation process includes a rougher circuit configured to receive the first enhanced scavenger circuit feed and provide a rougher circuit feed for further processing by the system.

2. A system according to claim 1, wherein the one or more scavenger circuits include a scavenger circuit configured to provide a scavenger circuit feed; and the one or more enhanced scavenger circuits comprises an enhanced scavenger circuit configured to receive the scavenger circuit feed and provide the first enhanced scavenger circuit feed as final tails and the second enhanced scavenger circuit feed for further processing by the system.

3. A system according to claim 1, wherein the flotation process include a regrind mill configured to receive the second enhanced scavenger circuit feed, and provide a regrind mill feed for further processing by the system.

4. A system according to claim 3, wherein the flotation process includes a cyclone circuit configured to provide a cyclone U/F circuit feed; and the regrind mill is configured to receive the cyclone U/F circuit feed, and provide the regrind mill feed for further processing by the system.

5. A system according to claim 4, wherein the regrind mill is configured to provide the regrind mill feed to the cyclone circuit for further processing by the cyclone circuit.

6. A system according to claim 1, wherein the flotation process includes a second scavenger circuit configured to provide a second scavenger circuit feed; and the rougher circuit is also configured to receive the second scavenger circuit feed and provide the rougher circuit feed for further processing by the system.

7. A system according to claim 1, wherein the flotation process includes a regrind mill configured to receive the second enhanced scavenger circuit feed, and provide a regrind mill feed for further processing by the system.

8. A system according to claim 7, wherein the flotation process includes a cyclone circuit configured to provide a cyclone U/F circuit feed; and the regrind mill is configured to receive the cyclone U/F circuit feed, and provide the regrind mill feed for further processing by the system.

9. A system according to claim 8, wherein the regrind mill is configured to provide the regrind mill feed to the cyclone circuit for further processing by the cyclone circuit.

10. A system according to claim 8, wherein the cyclone circuit is configured to provide a cyclone O/F circuit feed; and the flotation process includes a cleaner column circuit configured to receive the cyclone O/F circuit feed, and provide a cleaner column circuit feed for further processing by the system.

11. A system according to claim 10, wherein the cleaner scavenger circuit is configured to provide a second cleaner scavenger circuit feed; and the cleaner column is configured to receive the second cleaner scavenger circuit feed and provide the cleaner column feed for further processing by the cleaner scavenger circuit.

12. A system according to claim 8, wherein the enhanced scavenger circuit is configured to receive the cleaner scavenger circuit feed and provide the first enhanced scavenger circuit feed and the second enhanced scavenger circuit feed for further processing by the system.

13. A system according to claim 1, wherein the one or more scavenger circuits includes:

a scavenger circuit configured to provide a scavenger circuit feed, and a cleaner scavenger circuit configured to provide a cleaner scavenger circuit feed; and the one or more enhanced scavenger circuits comprises:

a first enhanced scavenger circuit configured to receive the scavenger circuit feed and provide a corresponding first enhanced scavenger circuit feed with corresponding tails and a corresponding second enhanced scavenger circuit feed with corresponding concentrate for further processing by the system; and a second enhanced scavenger circuit configured to receive the cleaner scavenger circuit feed and provide an associated first enhanced scavenger circuit feed with associated tails and an associate second enhanced scavenger circuit feed with associated concentrate for further processing by the system.

14. A system according to claim 13, wherein the flotation process includes a regrind mill; and the regrind mill is configured to receive the corresponding concentrate, and the associate concentrate, and provide a regrind mill feed for further processing by the system.

15. A system according to claim 14, wherein the flotation process includes a cyclone circuit configured to provide a cyclone circuit feed; and the regrind mill is configured to receive the cyclone circuit feed, and provide the regrind mill feed for further processing by the system.

16. A system according to claim 15, wherein the regrind mill is configured to provide the regrind mill feed to the cyclone circuit for further processing by the cyclone circuit.

17. A system according to claim 15, wherein the flotation process includes a rougher circuit configured to receive the associated tails and provide a rougher circuit feed for further processing by the system.

18. A system according to claim 17, wherein the rougher circuit is configured to receive a scavenger circuit feed from the scavenger circuit and provide the rougher circuit feed for further processing by the system.

19. A system according to claim 13, wherein the system comprises a screen circuit configured to receive the corresponding concentrate and the associate concentrate, and provide screen circuit feeds having a screen circuit U/S feed with a final concentrate and a screen circuit O/S feed for further processing by the process flotation process.

20. A system according to claim 19, wherein the flotation process includes a regrind mill; and the regrind mill is configured to receive the screen circuit O/S feed, and provide a regrind mill feed for further processing by the system.

21. A system according to claim 1, wherein the functional group comprises an ionizing bond for bonding the mineral particles of interest to the molecules.

22. A system according to claim 21, wherein the synthetic material is selected from a group consisting of polyamides, polyesters, polyurethanes, phenol-formaldehyde, urea-formaldehyde, melamine-formaldehyde, polyacetal, polyethylene, polyisobutylene, polyacrylonitrile, poly(vinyl chloride), polystyrene, poly(methyl methacrylates), poly(vinyl acetate), poly(vinylidene chloride), polyisoprene, polybutadiene, polyacrylates, poly(carbonate), phenolic resin, and polydimethylsiloxane.

23. A system according to claim 1, wherein the functional group is configured to render the collection area hydrophobic.

24. A system according to claim 23, wherein the synthetic material is selected from a group consisting of polystyrene, poly(d,l-lactide), poly(dimethylsiloxane), polypropylene, polyacrylic, polyethylene, hydrophobically-modified ethyl hydroxyethyl cellulose polysiloxanates, alkylsilane and fluoroalkylsilane.

25. A system according to claim 23, wherein the mineral particles of interest have one or more hydrophobic molecular segments attached thereon, and the tailings have a plurality of molecules, each collector molecule comprising a first end and a second end, the first end comprising the functional group configured to attach to the mineral particles of interest, the second end comprising a hydrophobic molecular segment.

26. A system according to claim 23, wherein the synthetic material comprise a siloxane derivative.

27. A system according to claim 23, wherein the synthetic material comprise polysiloxanates or hydroxyl-terminated polydimethylsiloxanes.

28. A system according to claim 1, wherein the collection surface is configured to contact the tailings over a period of time for providing an enriched collection surface in the collection apparatus, containing the mineral particles of interest, said system further comprising:

a release processor configured to receive the collection apparatus having the enriched collection surface, the release processor further configured to provide a release medium for releasing the mineral particles of interest from the enriched collection surface.

29. A system according to claim 28, wherein said release medium comprises a liquid configured to contact with the enriched collection surface, the liquid having a pH value ranging from 0 to 7.

30. A system according to claim 28, wherein said release medium comprises a liquid configured to contact with the enriched collection surface, said system further comprising:

an ultrasound source configured to apply ultrasound waves to the enriched collection area for releasing the mineral particles of interest from the enriched collection surface.

31. A system according to claim 1, where a part of the collection surface is configured to have the molecules attached thereto, wherein the molecules comprise collectors.

32. A system according to claim 31, where another part of the collection surface is configured to be hydrophobic.

33. A system according to claim 1, where a part of the collection surface is configured to be hydrophobic.

34. A system according to claim 1, wherein the at least one collection apparatus comprises reticulated foam or a reticulated foam block providing the three-dimensional open-cell structure.

35. A system according to claim 34, wherein the three-dimensional open-cell structure comprises an open cell foam.

36. A system according to claim 35, wherein the open cell foam is made from a material or materials selected from a group that includes polyester urethanes, polyether urethanes, reinforced urethanes, composites like PVC coated PU, non-urethanes, as well as metal, ceramic, and carbon fiber foams and hard, porous plastics, in order to enhance mechanical durability.

37. A system according to claim 35, wherein the open cell foam is coated with polyvinylchloride, and then coated with a compliant, tacky polymer of low surface energy in order to enhance chemical durability.

38. A system according to claim 37, wherein the open cell foam is primed with a high energy primer prior to application of a functionalized polymer coating to increase the adhesion of the functionalized polymer coating to the surface of the open cell foam.

39. A system according to claim 37, wherein the surface of the open cell foam is chemically or mechanically abraded to provide "grip points" on the surface for retention of the functionalized polymer coating.

40. A system according to claim 37, wherein the surface of the open cell foam is coated with a functionalized polymer coating that covalently bonds to the surface to enhance the adhesion between the functionalized polymer coating and the surface.

41. A system according to claim 37, wherein the surface of the open cell foam is coated with a functionalized polymer coating in the form of a compliant, tacky polymer of low surface energy and a thickness selected for capturing certain mineral particles and collecting certain particle sizes, including where thin coatings are selected for collecting proportionally smaller particle size fractions and thick coatings are selected for collecting additional large particle size fractions.

42. A system according to claim 34, wherein the specific surface area is configured with a specific number of pores per inch that is determined to target a specific size range of mineral particles in the slurry.

43. A system according to claim 34, wherein the at least one collection apparatus comprises different open cell foams having different specific surface areas that are blended to recover a specific size distribution of mineral particles in the slurry.

44. A method for implementing a system having a collection processor configured to receive tailings of a flotation process, the tailings having mineral particles of interest; and at least one collection apparatus located in the collection processor, the collection apparatus having a collection surface configured with a functionalized polymer comprising a plurality of molecules having a functional group configured to attract the mineral particles of interest to the collection surface, the flotation process having one or more scavenger circuits configured to provide one or more scavenger circuit feeds having scavenger tails, wherein the method comprises configuring the system with one or more enhanced scavenger circuits having the at least one collection apparatus located in the collection processor and configured to receive the one or more scavenger circuit feeds and provide enhanced scavenger circuit feeds having a first enhanced scavenger circuit feed with enhanced scavenger tails and a second enhanced scavenger circuit feed with enhanced scavenger concentrate for further processing by the system, based upon the at least one collection apparatus located in the collection processor, wherein the one or more scavenger circuits includes a cleaner scavenger circuit configured to provide a cleaner scavenger circuit feed; and the one or more enhanced scavenger circuits comprises an enhanced scavenger circuit configured to receive the cleaner scavenger circuit feed and provide the first enhanced scavenger circuit feed and the second enhanced scavenger circuit feed for further processing by the system, and wherein the flotation process includes a rougher circuit configured to receive the first enhanced scavenger circuit feed and provide a rougher circuit feed for further processing by the system.

* * * * *